US011662173B1

(12) United States Patent
Enderle et al.

(10) Patent No.: US 11,662,173 B1
(45) Date of Patent: May 30, 2023

(54) APPARATUS AND METHODS FOR LAUNCH TOYS HAVING ROTATABLE PROJECTILE CARRIERS

(71) Applicant: Hasbro, Inc., Pawtucket, RI (US)

(72) Inventors: Alyssa Enderle, Providence, RI (US); Lauren Pulner, Cumberland, RI (US); Dennis Bernal, West Warwick, RI (US)

(73) Assignee: Hasbro, Inc., Pawtucket, RI (US)

( * ) Notice: Subject to any disclaimer, the term of this patent is extended or adjusted under 35 U.S.C. 154(b) by 0 days.

(21) Appl. No.: 17/586,608

(22) Filed: Jan. 27, 2022

Related U.S. Application Data

(60) Provisional application No. 63/143,899, filed on Jan. 31, 2021.

(51) Int. Cl.

| | |
|---|---|
| ***F41B 11/00*** | (2013.01) |
| ***F41B 11/54*** | (2013.01) |
| ***F41B 11/89*** | (2013.01) |
| ***F41B 11/723*** | (2013.01) |
| ***F41B 11/642*** | (2013.01) |

(52) U.S. Cl.
CPC ..... *F41B 11/54* (2013.01); *F41B 11/642* (2013.01); *F41B 11/723* (2013.01); *F41B 11/89* (2013.01)

(58) Field of Classification Search
CPC ..... F41B 4/00; F41B 11/54; F41B 11/642; F41B 11/62; F41B 11/723; F41B 11/89; F41B 11/55; F41B 11/64; A63B 69/406; F41A 3/58
USPC .... 124/59, 66, 73, 6, 78, 65, 1, 51.1, 56, 82
See application file for complete search history.

(56) References Cited

U.S. PATENT DOCUMENTS

| | | | | | |
|---|---|---|---|---|---|
| 46,617 | A | | 3/1865 | Allen | |
| 159,609 | A | | 2/1875 | Prescott | |
| 956,760 | A | | 5/1910 | Moulin | |
| 1,441,975 | A | | 1/1923 | Edelin | |
| 1,488,995 | A | | 4/1924 | McCollom | |
| 2,090,731 | A | * | 8/1937 | Klein | F41B 11/68 43/6 |
| 2,307,015 | A | * | 1/1943 | Boynton | F41B 11/68 124/73 |
| 2,737,942 | A | | 3/1956 | Horowitz et al. | |
| 3,054,536 | A | | 9/1962 | Sagarin | |
| 3,262,440 | A | | 7/1966 | Kuhn | |
| 3,381,403 | A | * | 5/1968 | Murdoch | F41B 11/85 42/106 |
| 3,420,133 | A | | 1/1969 | Proll | |
| 3,662,729 | A | * | 5/1972 | Henderson | A63B 69/409 124/81 |
| 3,990,426 | A | | 11/1976 | Stokes | |
| 4,348,938 | A | * | 9/1982 | Gillum | F41A 9/49 89/33.17 |
| 4,597,527 | A | | 7/1986 | Sands | |
| 4,774,929 | A | | 10/1988 | Millman | |
| 4,841,945 | A | | 6/1989 | Braden | |

(Continued)

*Primary Examiner* — Michael D David
(74) *Attorney, Agent, or Firm* — Perry Hoffman

(57) ABSTRACT

A projectile launch apparatus for discharging a NERF™ brand dart, or toy launchers each having a rotatable dart carrier in either a gun-like or rifle-like configuration. Each of the apparatus includes an energy creation system embodying a cylinder housing a piston and a launch spring, a handle for priming the apparatus, and components for causing the dart carrier to rotate about an axis perpendicular to the longitudinal axis of the launch apparatus.

20 Claims, 27 Drawing Sheets

(56) References Cited

U.S. PATENT DOCUMENTS 4,890,404 A 1/1990 Ferri
4,890,597 A * 1/1990 Ekstrom ..... F41B 11/83 124/71
5,086,749 A * 2/1992 Ekstrom ..... F41B 11/83 124/71
5,205,271 A 4/1993 Salva
5,244,153 A 9/1993 Kuhn et al.
5,267,549 A 12/1993 Webber
5,343,850 A 9/1994 Steer
5,471,967 A 12/1995 Matsuzaki et al.
5,529,050 A 6/1996 D'Andrade
5,535,729 A 7/1996 Griffin et al.
5,704,150 A 1/1998 Millman
5,878,734 A 3/1999 Johnson et al.
6,119,671 A 9/2000 Smith et al.
6,152,125 A * 11/2000 Piper ..... F41B 11/52 124/59
6,488,019 B2 12/2002 Kotsiopoulos
7,051,727 B2 5/2006 Wu
7,458,485 B2 * 12/2008 Amron ..... F41B 9/0018 239/222.11
7,926,408 B1 * 4/2011 Kley ..... F42B 10/40 89/41.17
8,082,909 B2 12/2011 Sopinsky et al.
8,113,188 B2 2/2012 Ma
8,127,753 B1 3/2012 Brooks et al.
8,127,754 B1 3/2012 Johnson et al.
8,336,531 B2 12/2012 Fan et al.
8,397,705 B2 3/2013 DeHaan et al.
8,567,378 B2 10/2013 Nugent
8,695,579 B2 4/2014 Huebl
8,875,688 B2 11/2014 Nugent
9,389,042 B1 7/2016 Clayton
9,500,436 B2 11/2016 Macy
9,958,230 B1 5/2018 Nugent et al.
10,823,527 B2 11/2020 Tino et al.
2002/0166551 A1 11/2002 Lee
2004/0065310 A1 * 4/2004 Masse ..... F41B 11/71 124/75
2007/0017497 A1 * 1/2007 Masse ..... F41B 11/73 124/73
2008/0295818 A1 * 12/2008 Styles ..... F41B 11/62 124/83
2009/0095272 A1 4/2009 Zimmerman
2009/0241931 A1 * 10/2009 Masse ..... F41B 11/62 124/76
2010/0206281 A1 8/2010 Kanitz et al.
2011/0083654 A1 * 4/2011 Galinson ..... F41B 11/54 124/71
2012/0180772 A1 * 7/2012 St. Phillips ..... F41B 11/62 124/73
2013/0112184 A1 5/2013 Corsiglia et al.
2013/0192576 A1 * 8/2013 Ma ..... F41B 9/0071 124/73
2013/0312722 A1 11/2013 Price
2015/0253101 A1 * 9/2015 Scarr ..... F41B 11/73 124/73
2016/0018184 A1 1/2016 Park
2016/0161225 A1 * 6/2016 Searle ..... A63B 71/0036 124/56
2017/0153082 A1 * 6/2017 Maeda ..... F41B 11/62
2020/0096287 A1 * 3/2020 Miller ..... F41B 11/54
2021/0055068 A1 * 2/2021 Calvete ..... F41C 9/08

* cited by examiner

APPARATUS AND METHODS FOR LAUNCH TOYS HAVING ROTATABLE PROJECTILE CARRIERS

PRIORITY CROSS-REFERENCE TO RELATED APPLICATIONS

This application claims priority pursuant to 35 U.S.C. 119(e) from U.S. Provisional Patent Application No. 63/143,899 filed on Jan. 31, 2021.

FIELD OF THE INVENTION

The present invention relates generally to projectile launch apparatus, systems, and methods, and more particularly to projectile launchers having rotating barrel carriers to enable an operator to bring a multitude of projectiles into a launch position quickly and easily.

BACKGROUND OF THE INVENTION

U.S. Pat. No. 5,343,850 for a "Double Shot Projectile Launcher" to Steer purports to disclose a double barrel launcher using a bellows for generating a blast of compressed air. The path of the compressed air is determined by manipulation of a trigger that operates a slide valve. The slide valve aligns openings to clear an air path to one of two projectile supporting launch tubes. When the slide valve misaligns the openings to the launch tube, the air path is blocked. Griffin, et al. U.S. Pat. No. 5,535,729 to Applicant's Assignee for "Projectile Launcher" discloses an air gun having a fixed plurality of launch tubes and a rotatable cylinder and piston for directing a blast of compressed air to a distribution manifold which directs the air to each of the launching tubes sequentially whether loaded or not. The compressed air is first directed axially from the piston, then radially in one of the distribution passages, and finally axially to the aligned launch tube. Various toy and game launchers using high-pressure air are known in the art of interest, including Nugent U.S. Pat. No. 8,567,378, and Nugent U.S. Pat. No. 8,875,688 to Applicant's Assignee. Also, various valves and triggers are known in the art, including safety valves exemplified by U.S. Pat. No. 5,529,050.

SUMMARY OF THE INVENTION

The present invention relates to unique toy projectile launch apparatus where each launcher includes a rotatable dart carrier, an energy creation system, a priming handle for compressing a launch spring, and components for causing the carrier to rotate.

BRIEF DESCRIPTION OF THE DRAWINGS

For the purpose of facilitating an understanding of the invention, the accompanying drawings and detailed description illustrate preferred embodiments thereof, from which the invention, its structures, its constructions and operations, its processes, and many related advantages may be readily understood and appreciated.

DETAILED DESCRIPTION OF THE EMBODIMENTS

The following description is provided to enable those skilled in the art to make and use the described embodiments set forth in the best mode contemplated for carrying out the invention. Various modifications, equivalents, variations, and alternatives, however, will remain readily apparent to those skilled in the art. Any and all such modifications, variations, equivalents, and alternatives are intended to fall within the spirit and scope of the present invention and its claims.

Five embodiments of toy projectile launch apparatus are illustrated, each with at least one rotatable barrel, to enable the toy launch apparatus to launch one or more projectiles quickly, some in a first mode, then have the barrels rotate, and thereafter, launch one or more projectiles in a second mode.

Eight Shot Toy Launch Apparatus

Figure 1:
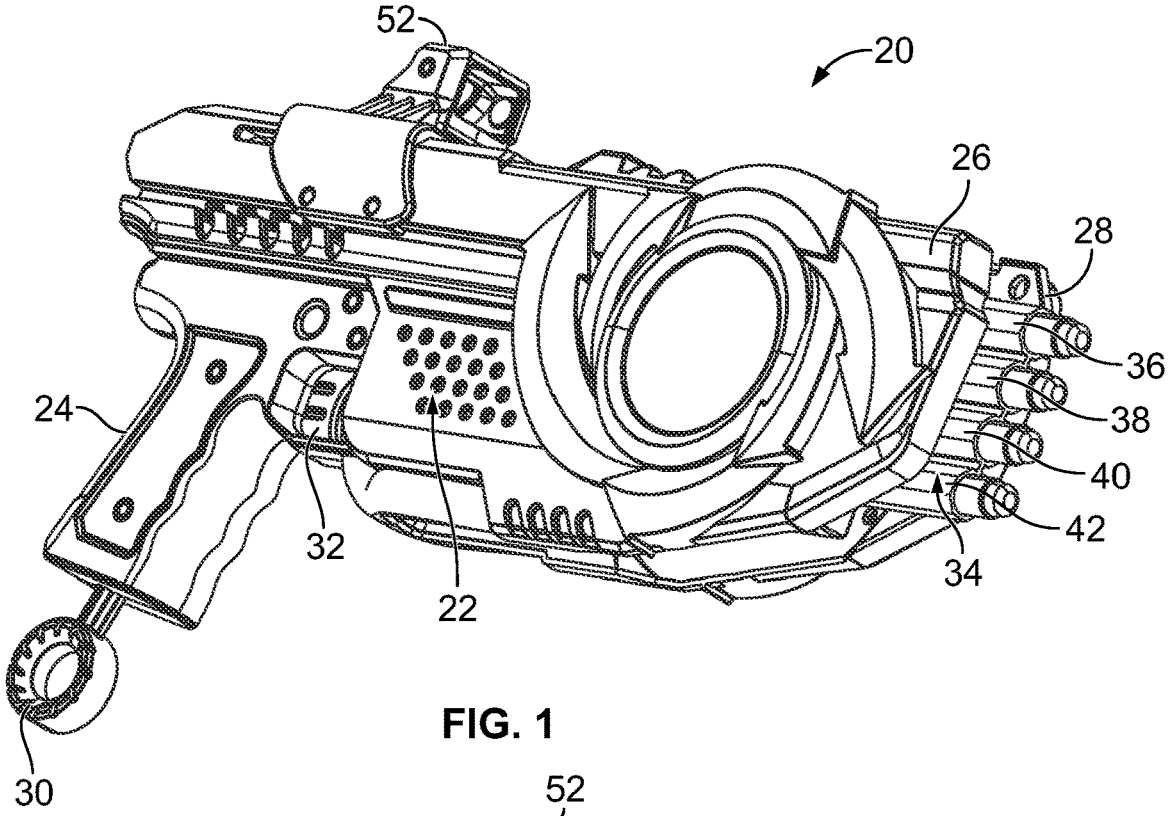
FIG. 1 is an isometric view of an eight shot toy launch apparatus.
Figure 2:
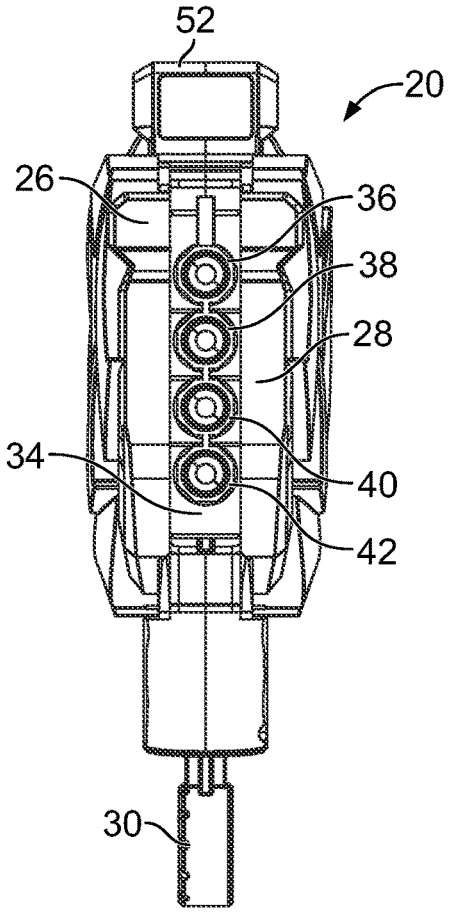
FIG. 2 is a front elevation view of the toy launch apparatus illustrated in FIG. 1.

One embodiment of a toy launch apparatus is shown in FIGS. 1-7, where an eight shot apparatus 20 is illustrated. Referring first to FIGS. 1 and 2, the toy launch apparatus 20 includes a blaster or simulated gun-like outer housing 22, with a rearward grip 24, and left and right forward support arms 26, 28. The toy launch apparatus 20 also includes a priming handle 30 extending downward from the grip 24, a trigger 32 mounted to the outer housing 22, an eight shot barrel carrier 34 having eight barrels 36, 38, 40, 42, 44, 46, 48, 50, FIG. 6, mounted to the support arms 26, 28 of the outer housing 22, and a rotational handle 52 mounted to top of the outer housing 22 for causing the barrel carrier 34 to be rotated 180°. Having a rotational barrel carrier allows an operator to carry more ready-to-launch projectiles before having to reload.

Energy Creation System

Figure 3:
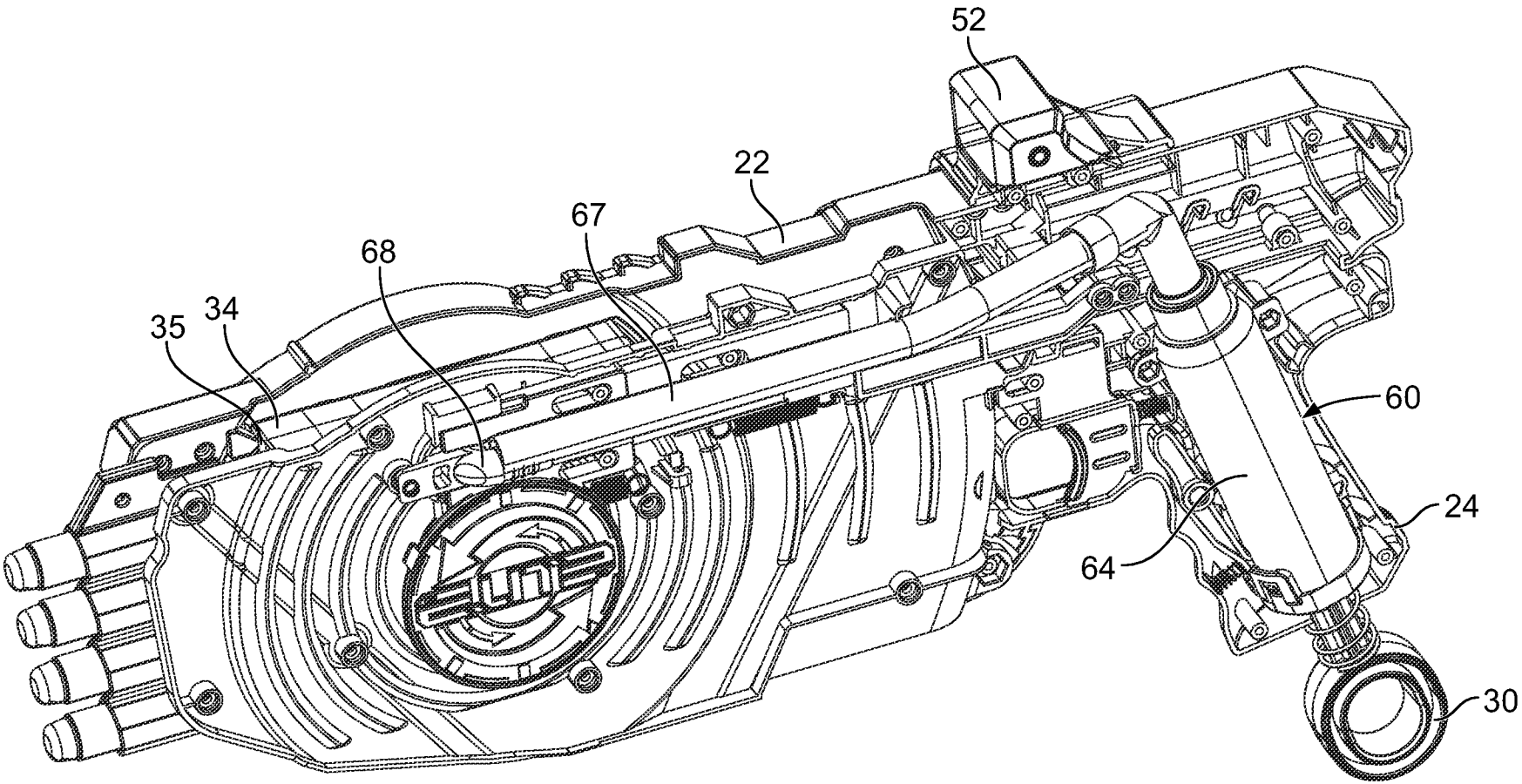
FIG. 3 is an isometric view of the toy launch apparatus illustrated in FIG. 1, with the left side of an outer housing removed to show a compressed air conduit and an energy creation system.
Figure 4:
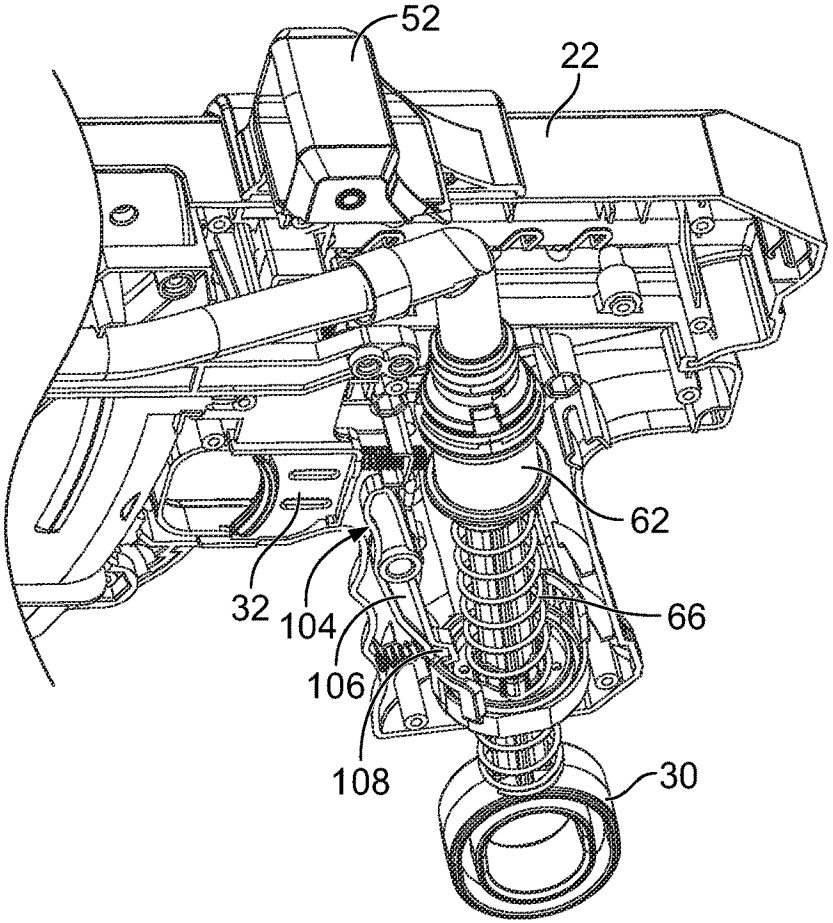
FIG. 4 is an isometric view of a grip portion of the toy launch apparatus illustrated in FIG. 1, showing a piston, a launch spring and a priming handle.
Figure 8:
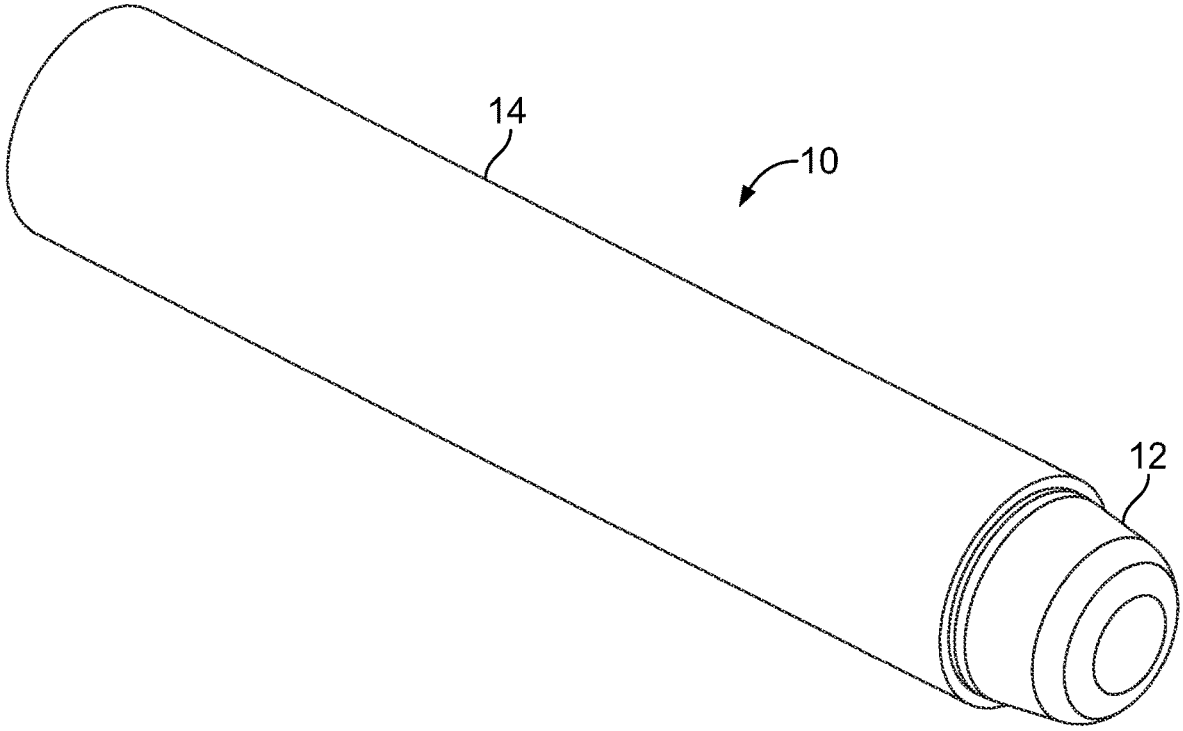
FIG. 8 is a front isometric view of a NERF™ brand foam dart.
Figure 9:
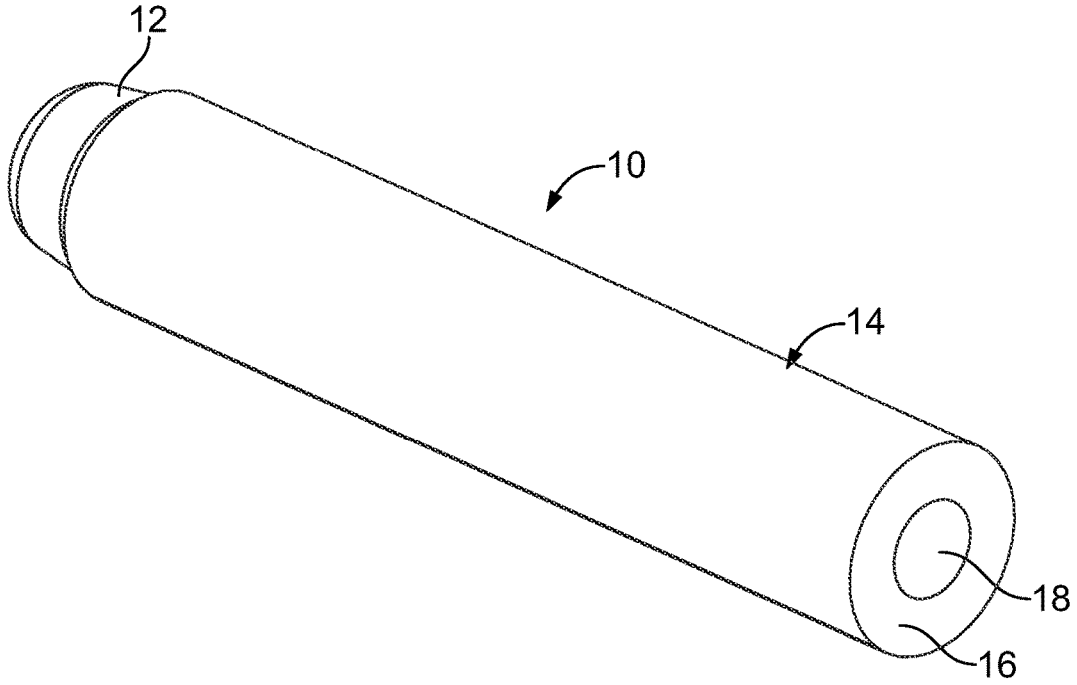
FIG. 9 is a rear isometric view of the foam dart shown in FIG. 8.

The eight shot toy launch apparatus 20 includes an energy creation system 60, FIGS. 3 and 4, located in the grip 24 for developing a high-pressure slug of air for launching a toy projectile, such as a dart 10, FIGS. 8 and 9. The energy creation system 60 embodies a piston 62, FIG. 4, in a cylinder 64, FIG. 4, and a launch spring 66 in the cylinder 64 below the piston with the priming handle 30 connected to the piston 62. High-pressure air generated by the energy creation system, when the spring and piston are released, flows from the cylinder 64 through an extended air conduit 67 to an air connector 68 and then to the barrel carrier 34. After loading darts in the barrels, an operator is able to pull the priming handle 30 downward causing the piston 62 to compress the launch spring 66 and become restrained. An earlier filed U.S. Pat. No. 10,823,527, entitled Toy Launcher Apparatus With Few Parts and Quick and Easy Assembly, illustrates and describes, in detail, the energy creation system 60, and is incorporated herein by reference.

Rotatable Carrier

Figure 6:
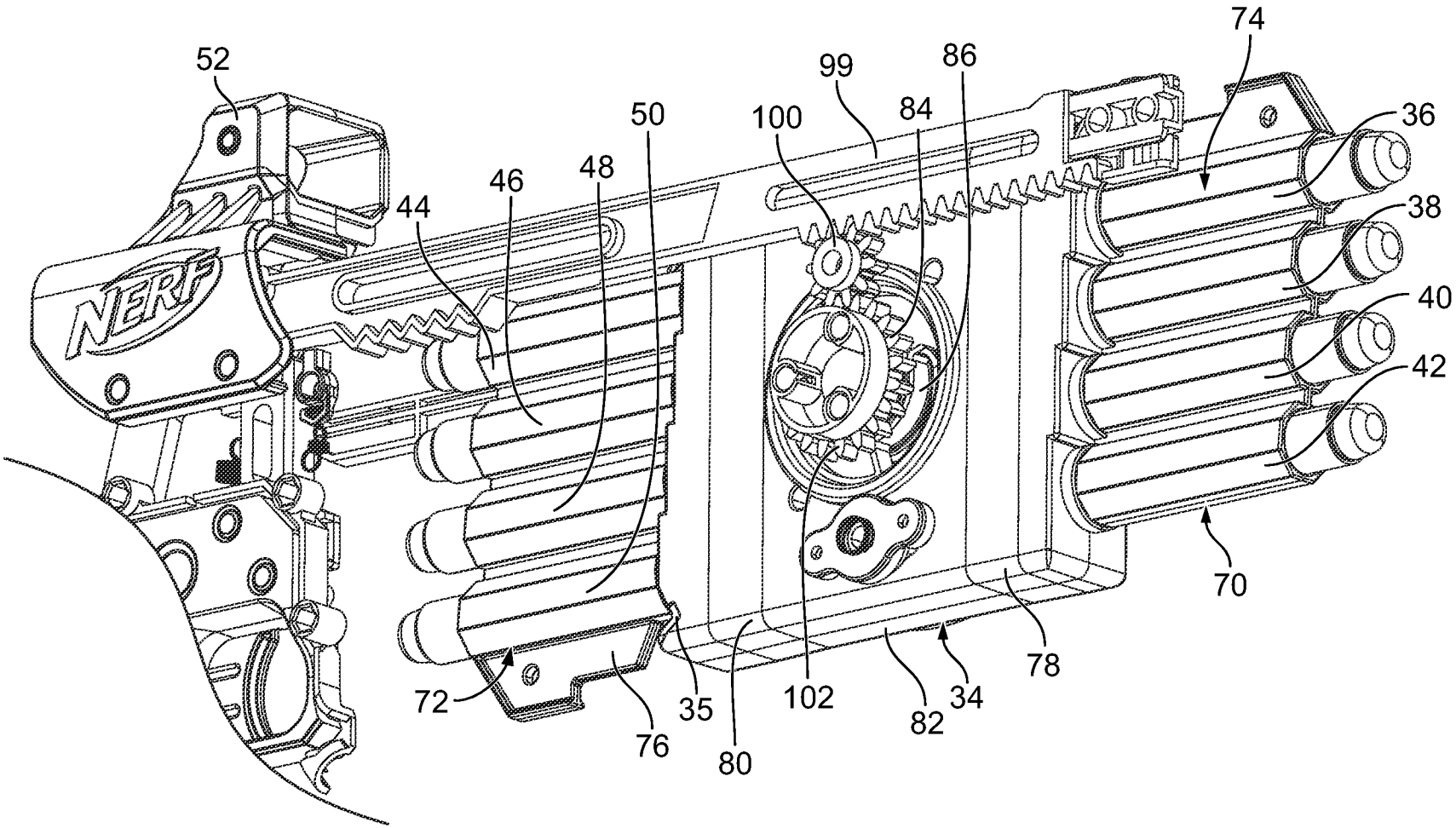
FIG. 6 is an isometric view of the priming handle, a rack and a gear train of the toy launch apparatus illustrated in FIG. 1.
Figure 7:
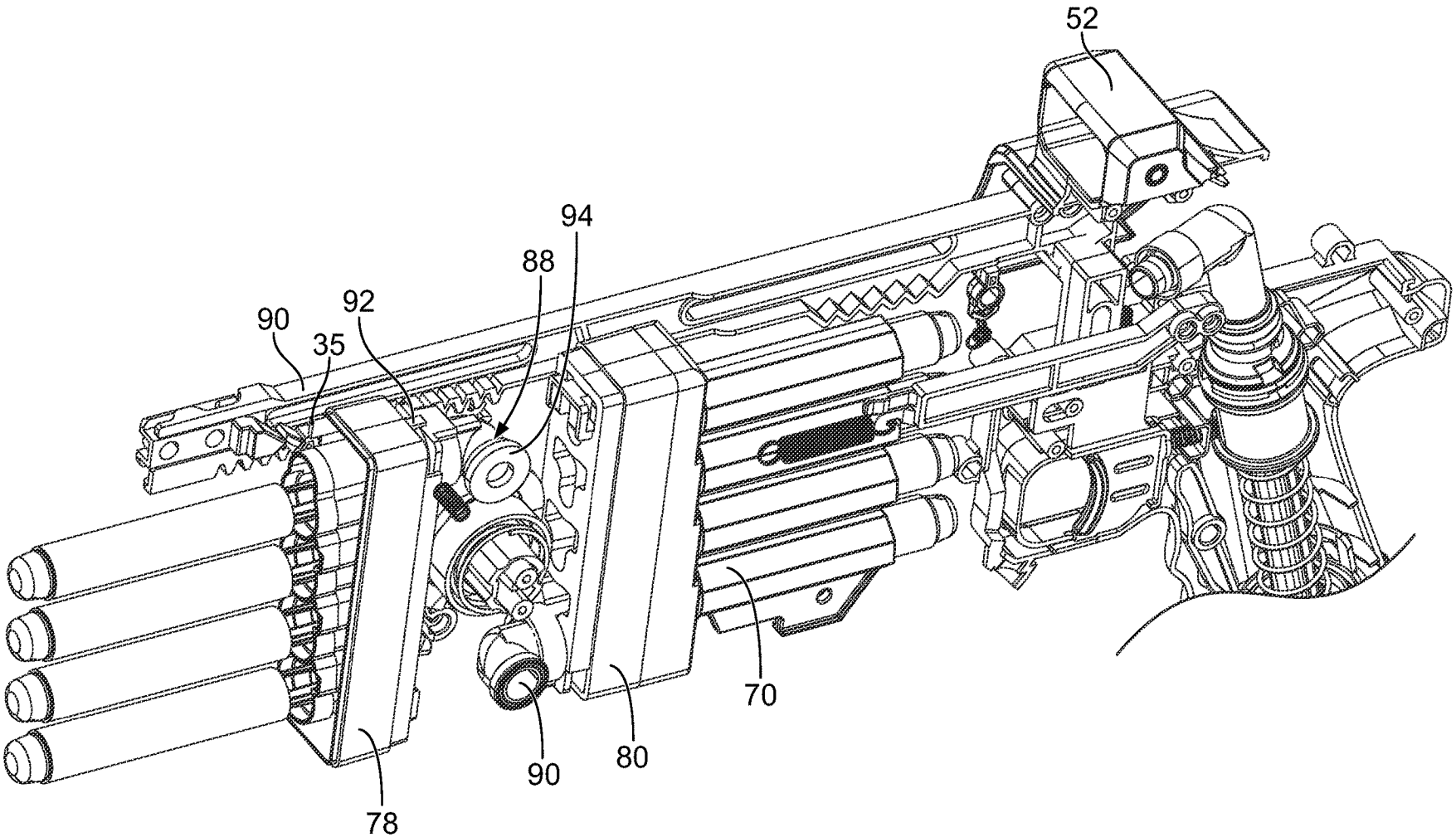
FIG. 7 is an isometric view of two inlet connectors of the toy launch apparatus illustrated in FIG. 1.

The eight shot carrier 34, FIG. 6, is configured with the eight barrels divided between two modules, a forward facing module 70 and a rearward-facing module 72. Each module 70, 72 include a bank of barrels 74, 76. Next to each bank of barrels is a passageway structure or valve system 78, 80 for automatically cascading each slug of high-pressure air from the cylinder 64 to each dart-loaded barrel in sequence while ignoring barrels that are empty. Once a dart is launched from its corresponding barrel, that barrel is closed off to high-pressure air. After priming the apparatus, the next slug of high-pressure air is directed to the next loaded barrel in a module. An earlier filed U.S. Pat. No. 8,567,378, entitled Air Path and Safety Valve System for Toy Launchers, illustrates and describes, in detail, the valve system and is incorporated herein by reference. After all or some of the loaded barrels in the forward facing bank of barrels are discharged, the operator may simply rotate the carrier 34 to bring a fresh bank of barrels with its own valve system to face forward and present four more or less darts to a discharge position.

Well-known safety features are included in all of the embodiments disclosed here so that a toy launch apparatus cannot be used to discharge an inappropriate object, such as a pencil. Safety components may include spike and a valve as disclosed in U.S. Pat. No. 8,875,688, which is incorporated herein by reference. The spike and valve are configured to receive a dart, like a dart 10, FIG. 8, which has a central opening 18 to receive the spike and a ring shaped rear surface 16 to open a valve to allow high-pressure air to enter when the dart is inserted in a barrel. Other safety components may be configured for projectiles having other configurations.

Rotation System

In the middle of each carrier is a center block 82, FIG. 6, which is rotatably mounted to the outer housing 22. Mounted to the center block 82 is a gear train 84 used to rotate the barrel carrier 34 and a clutch 86, to insure that the carrier only rotates one way, clockwise. At FIGS. 3, 6 and 7, a rubber bumper 35 is provided as part of the rotating structure stop which helps to dampen sound and stop the rotating piece hitting at the rubber bumper 35 when the barrel carrier 34 is rotated 180° and thus decreasing the loud sound at the end of the stroke. Also embodied in the center block 82 are two 90° inlet connectors 88, 90, FIG. 7, mounted to the valve systems 78, 80. Each inlet connector, such as the inlet connector 88, connects at one end 92 to a corresponding valve system, such as the valve system 78, and at the other end 94, to the air connector 68 and to the long air conduit 67 so as to direct a slug of high-pressure air from the cylinder 64 to a loaded barrel when in a first mode. However, when in a second mode, before rotation, the barrel carrier is separated from the source of high-pressure air. Rotation of the carrier results when the rotational handle 52 moves rearward and then returns, the return being by the operator or by a return spring. On the return, the handle does not engage any of the gears. Once the carrier 34 is rotated, the inlet connector 90 is engaged with the air connector 68.

Figure 5:
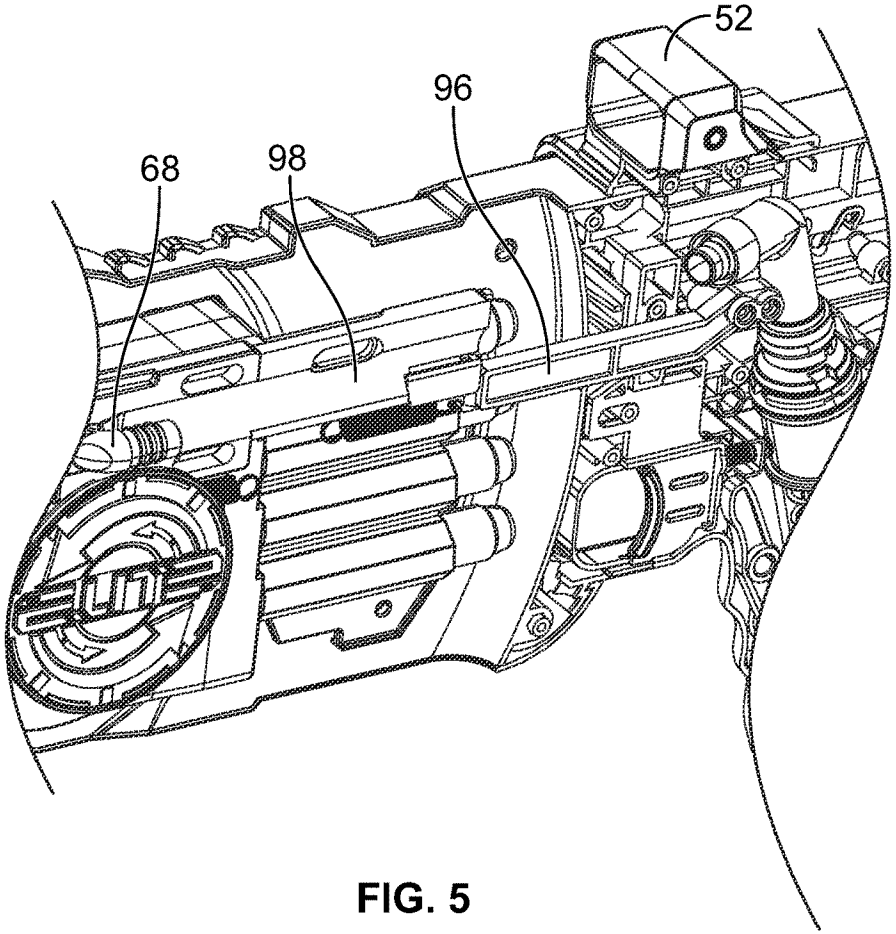
FIG. 5 is an isometric view of a link and an elongated cam in the toy launch apparatus illustrated in FIG. 1.

Along the left hand side of the toy launch apparatus 20, the conduit 67 is along side of a link 96, FIG. 5, and an elongated cam 98. The link 96 and the cam 98 are connected to the handle 52. When the rotational handle 52 is moved rearward, the link 96 moves the cam 98 rearward to cause the air connector 68 to move laterally away from the inlet connector 88. On the right hand side of the toy apparatus 20, the rotational handle 52 is also connected to a rack 99, FIG. 6, which is engaged with the gear train 84 to flip or rotate the carrier 34 through 180°. After rotation, the inlet connector 90 assumes the upper position and is aligned with the air connector 68, such that when the rotational handle 52 moves forward to finish the rotation cycle the air conduit 67 and the energy creation system 60 are align with the module 72 which is now facing forward.

When all four darts (or less) of one module are discharged, the operator may reload with four or less new darts; or, more likely during a "battle," the operator may simply rotate the carrier 180° to bring the second module of the carrier into launching position, facing forward. As mentioned, the two modules 70, 72 are identical. The eight shot toy launch apparatus 20 includes a rotation system embodying the rotational handle 52. The rotational handle 52 is connected to the rack 99 and the rack is connected to the gear train 84, which embodies a small gear 100, FIG. 6, connected to a large gear 102. The gears 100, 102 are mounted to the center block 82 to transfer the linear motion of the rotational handle 52 to rotational motion causing the carrier 34 to rotate. The clutch 86 allows rotation one-way, clockwise. Just prior to the actual rotation, the handle 52, the link 96 and the cam 98 cause a slight separation of the air conduit 67 and the air connector 68 from the carrier 34 and the inlet connector 88.

Trigger Assembly

The toy launch apparatus 20 includes a trigger assembly 104, FIG. 4, formed by the trigger 32 and a pivotal latch 106. When the launch apparatus is primed, a lower end 108 of the latch 106 is received by a recess in the piston 62 to restrain the launch spring 66 in a compressed configuration. Retracting the trigger 32 causes the latch 106 to pivot and release the piston 62 and the launch spring 66, and cause a high-pressure slug of air to be transmitted from the cylinder 64, through the conduit 67 into the valve system 78 and to the barrels of the bank 74 facing forward, resulting in the launch of a dart.

Operation

In operation of the eight shot toy launch apparatus, the operator may load a dart into each of the eight barrels (or less than eight if desired). The operator may then prime the toy launch apparatus by pulling down on the priming handle 30. When the trigger is pulled, a dart is discharged. The operator may then prime the launch apparatus several more times and pull the trigger after each priming cycle to launch the remaining darts in a first module. Thereafter, the operator may then load four more darts (or less) or he/she may pull the rotation handle 52 to rotate the carrier 34 and position the second module forward to enable four more darts (or less) to be discharged.

Dart

An example of a suitable projectile to be used in all five embodiments is illustrated in FIGS. 8 and 9, and is in the form of a colorful toy dart 10. The dart 10 is formed of soft foam and is marketed by Hasbro Inc. of Rhode Island under the brand NERF®. The dart includes a foam nose portion 12, a foam tubular body portion 14 with a ring shaped rear surface 16, and a central opening 18. The rear surface 16 and the central opening 18 act in conjunction with each other to meet safety criterions that prevent the launch of inappropriate objects.

It is noted that there are dozens of different dart or projectile configurations in the marketplace (and others may be configured in the future). Projectiles having other geometries and sizes may be used with the toy launch apparatus described herein provided that the barrel and ancillary components are modified according.

Sixteen Shot Toy Launch Apparatus

Figure 10:
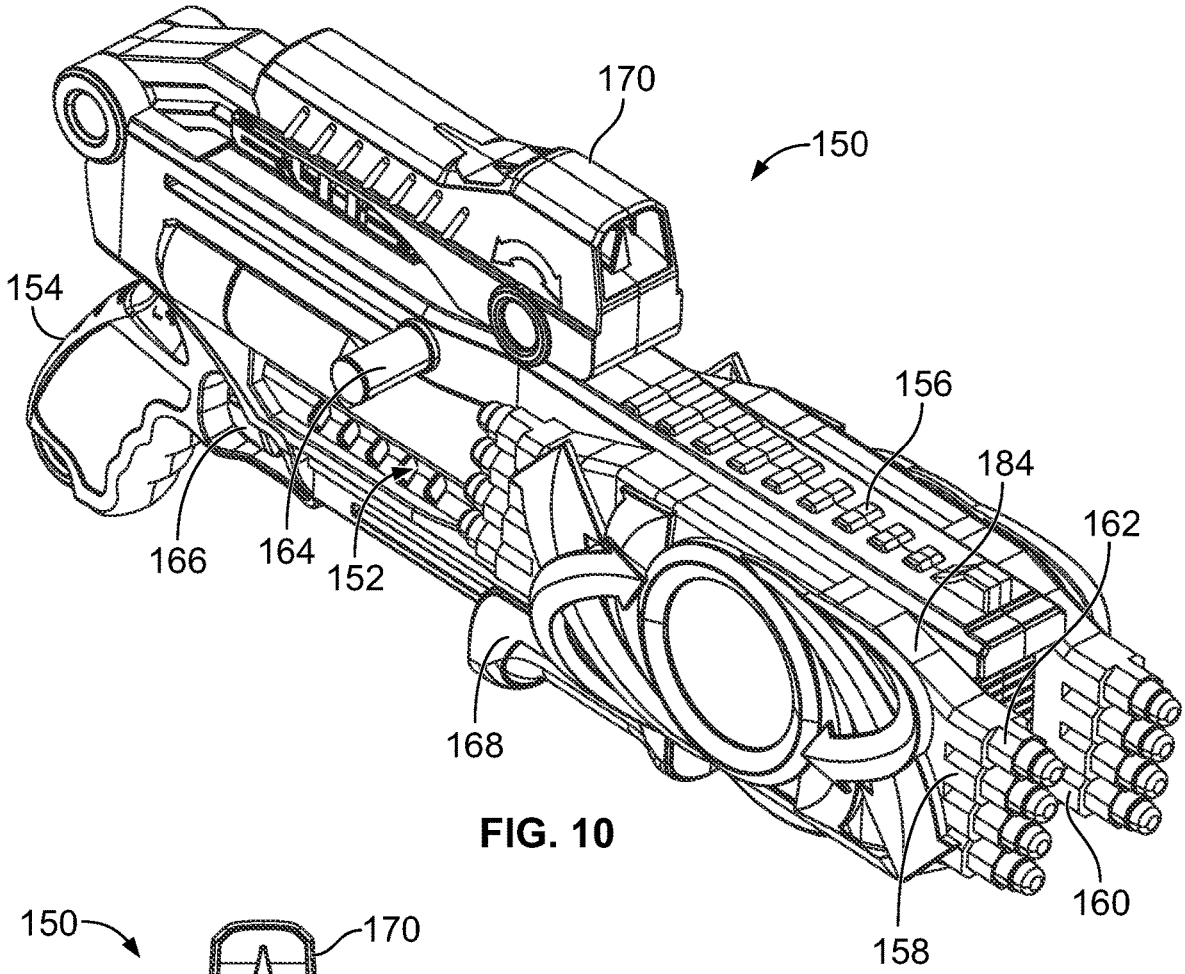
FIG. 10 is an isometric view of a sixteen shot toy launch apparatus.
Figure 11:
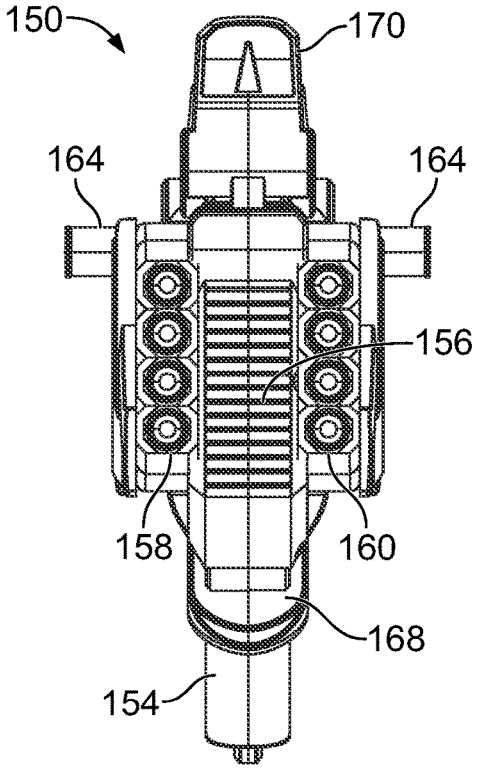
FIG. 11 is a front elevation view of the toy launch apparatus illustrated in FIG. 10.
Figure 12:
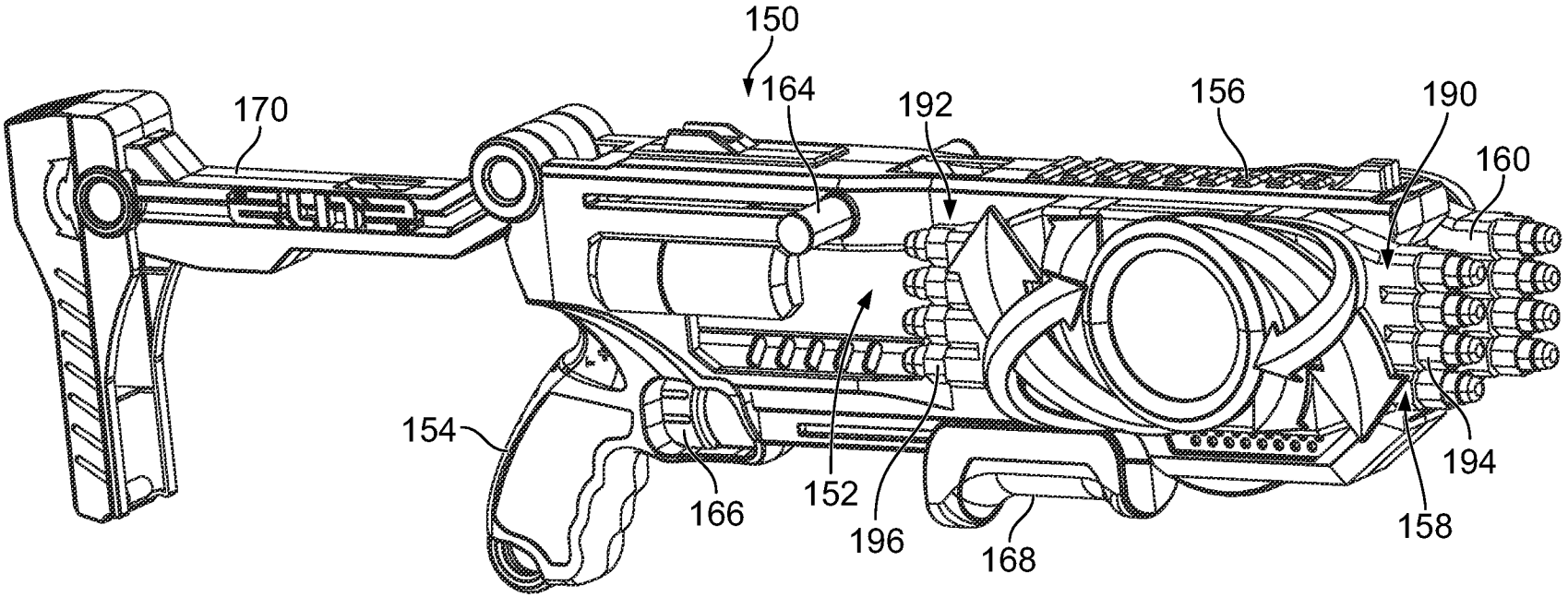
FIG. 12 is an isometric view of the toy launch apparatus illustrated in FIG. 10, with a stock in an extended position.
Figure 13:
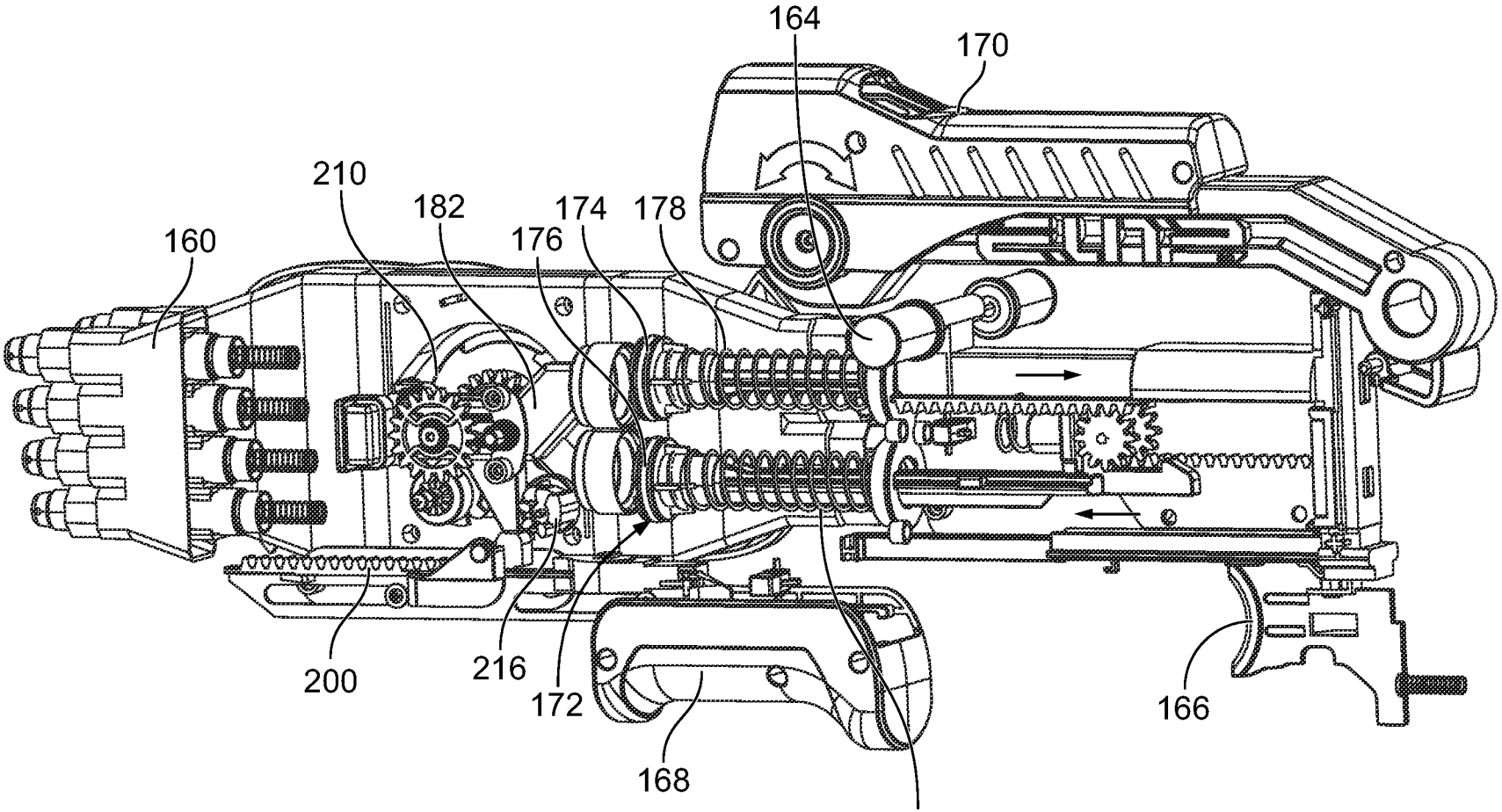
FIG. 13 is an isometric view of an energy creation system embodying pistons and launch springs in the toy launch apparatus illustrated in FIG. 10.

FIGS. 10-17 illustrate two more embodiments, namely, two versions of a toy launch apparatus 150, with a blaster outer housing 152, FIGS. 10 and 11, and in simulated rifle configuration in FIG. 12. The outer housing 152 includes a rearward grip 154 and a forward support arm 156. Left and right rotatable barrel carriers 158, 160, each with eight barrels, such as the barrel 162, are rotatably mounted to the support arm 156. A priming handle 164 is mounted to an upper portion of the outer housing 152. A trigger 166, a pump-style rotational handle 168 for causing the carriers 158, 160 to rotate, and a foldable stock 170 are all mounted to the outer housing 152. The stock is folded in FIGS. 10 and 11, and unfolded in FIG. 12.

The sixteen shot toy launch apparatus 150 is similar to the eight shot toy launch apparatus 20 but has two carriers 158, 160 having a total of sixteen darts. The sixteen shot launch apparatus 150 includes an energy creation system 172, FIG. 13, embodying two pistons 174, 176 and two launch springs 178, 180 disposed in two cylinders (not shown, but each is like the cylinder 64, FIG. 3) mounted in the outer housing 152 and positioned in a configuration generally parallel to a longitudinal axis of the toy apparatus 150. Each cylinder, piston and launch spring set is ducted to a separate carrier. A connector and manifold combination 182, FIGS. 13 and 15, transfers high-pressure air from the energy creation system 172 to the carriers 158, 160 by way of a valve system, such as the valve systems 184, FIG. 10, which is very much like the disclosure in U.S. Pat. No. 10,823,527, which is incorporated herein by reference. The priming handle 164 extends from both sides of the toy launch apparatus 150. Two darts, one from each carrier, may be launched after each priming cycle, pull rearward and then a push forward. In the alternative, a return spring may be used.

Each carrier 158, 160 of the sixteen shot apparatus 150 is nearly identical to the single carrier 34 of the eight shot launch apparatus 20. For example, the carrier 158 is configured with the eight barrels divided between two modules, a forward facing module 190, FIG. 12, and a rearward-facing module 192. Each module includes a bank of barrels 194, 196. Next to each bank of barrels are the valve systems, such as the valve system 182, for automatically cascading high-pressure compressed air from one dart-loaded barrel to the next barrel having a loaded dart. Once a dart is launched from its corresponding barrel, that barrel is closed off to high-pressure air from the energy creation system until the barrel is reloaded with a dart. After priming the apparatus, the next slug of high-pressure air is directed to the next loaded barrel in the module as disclosed in detail in U.S. Pat. No. 8,567,378 and incorporated herein by reference. Like the eight shot apparatus, the sixteen shot apparatus includes safety spikes and valves. After some or all of the loaded barrels in a bank are discharged, the operator may rotate the carriers to bring a fresh bank to face forward and present eight more darts to discharge positions. The operator may rotate the carriers back and forth, if desired, until all of the darts have been discharged, or some or all of the barrels may be reloaded at any convenient time.

Figure 14:
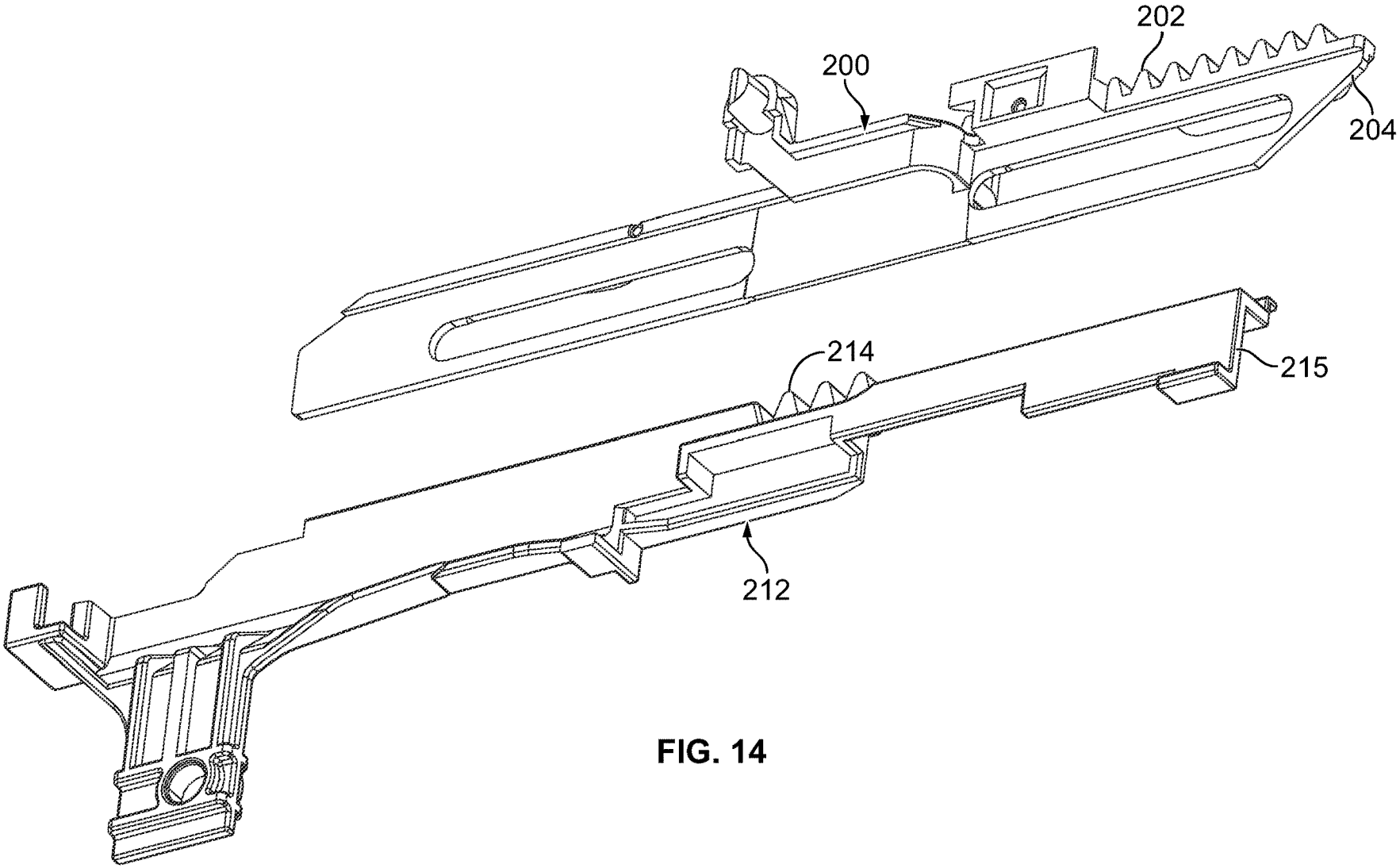
FIG. 14 is an enlarged isometric view of a rack for rotating the carriers and a rack for separating a connector and manifold component from a carrier, both in the toy launch apparatus illustrated in FIG. 10.
Figure 15:
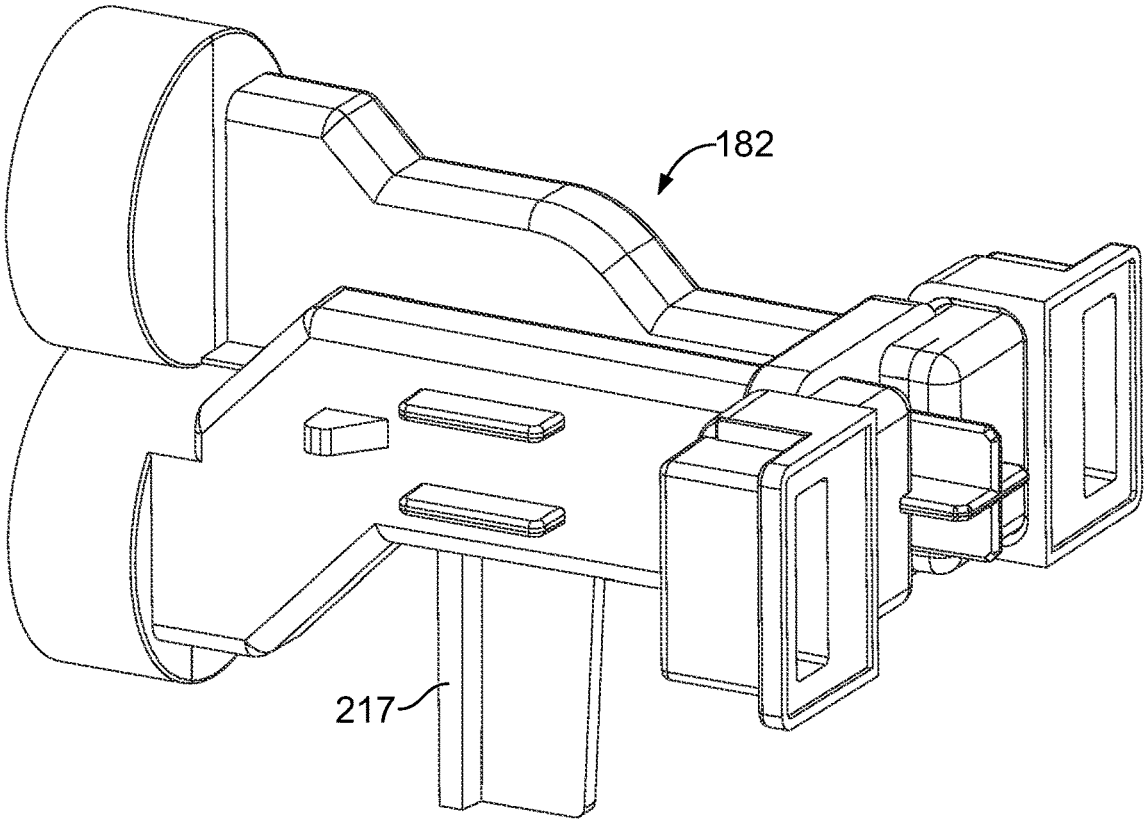
FIG. 15 is an enlarged isometric view of the connector and manifold in the toy launch apparatus illustrated in FIG. 10.
Figure 16:
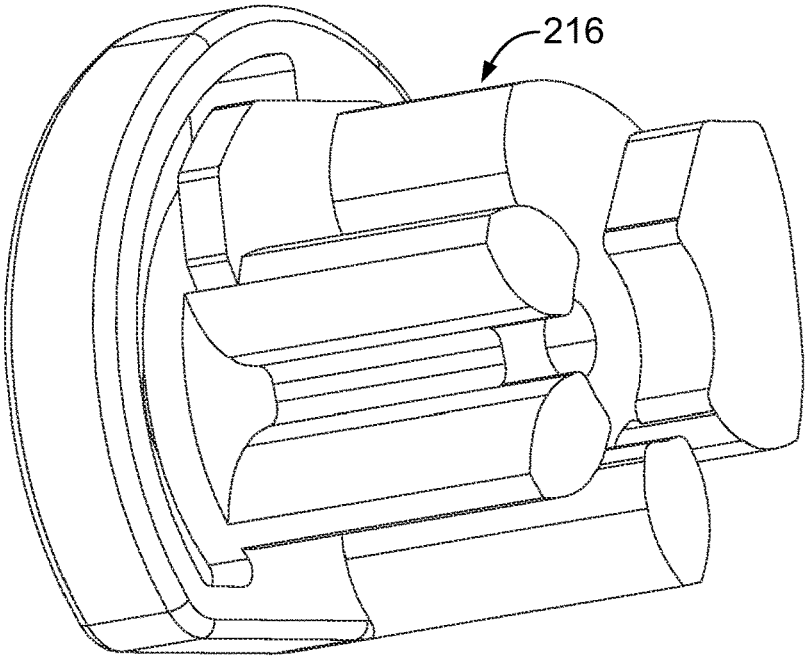
FIG. 16 is an enlarged isometric view of a gear and cam combination for moving the connector and manifold in the toy launch apparatus illustrated in FIG. 10.
Figure 17:
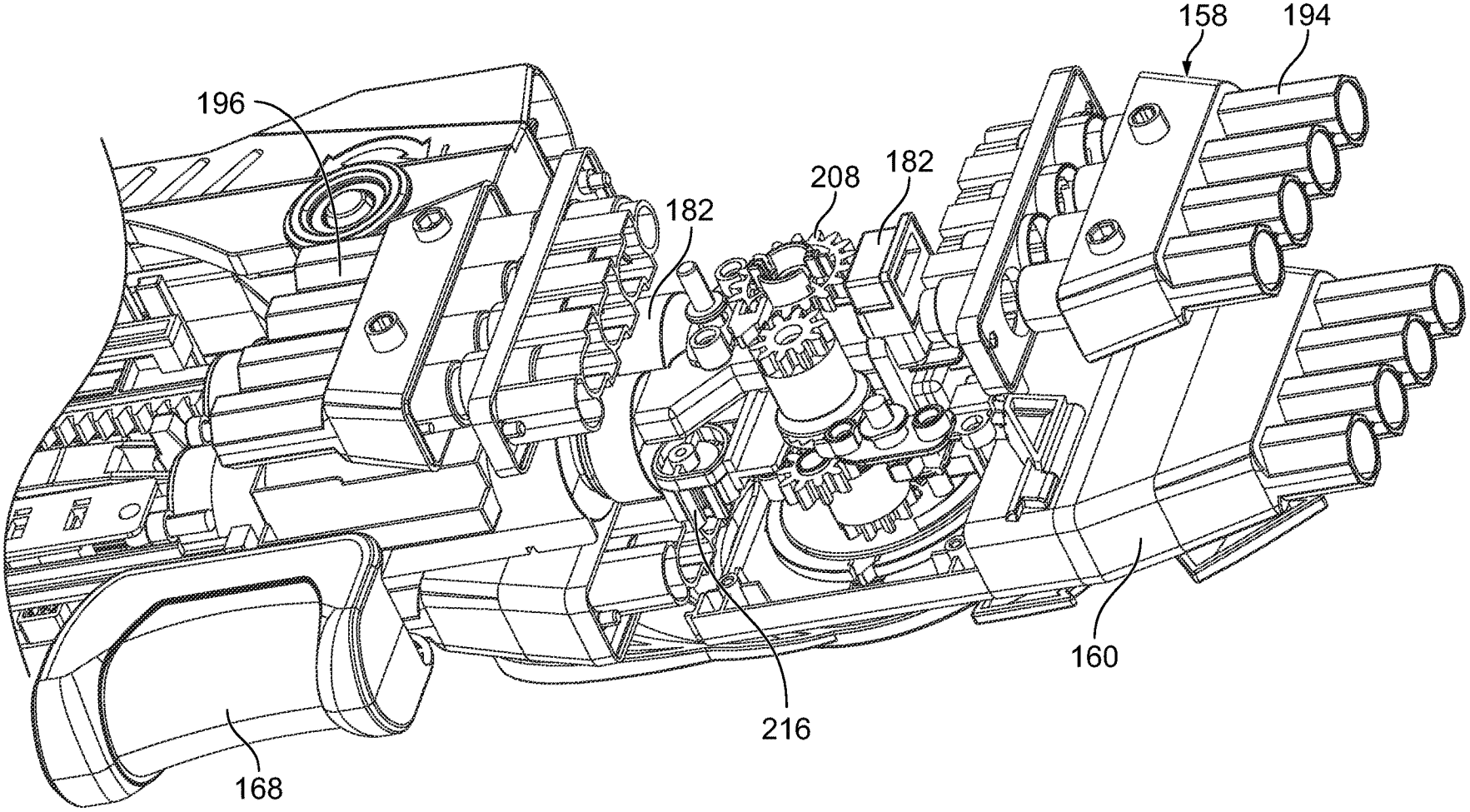
FIG. 17 is an enlarged isometric view of a rotation gear train in the toy launch apparatus illustrated in FIG. 10.

Rotating the barrel carriers 158, 160 is accomplished by two racks that are connected to the pump-style handle 168, such as the rack 200, FIG. 14 having gear teeth 202 at a distal end portion 204. The racks 200, 206 are positioned adjacent the right and left carriers 158, 160. A gear train is connected to each carrier, such as the gear train 208, FIG. 17, which is connected to the right side carrier 158, and the gear train 210, FIG. 13, connected to the left carrier 160. When the pump handle 168 is moved rearward, the racks 200, 206 and their corresponding gear trains 208, 210 cause the two carriers 158, 160 to rotate 180°. However, before the carriers are able to be rotated, a third rack 212, FIG. 14, also connected to the pump handle 168 and having gear teeth 214 spaced away from the distal end portion 215 operates a gear and cam combination 216, FIGS. 13, 16 and 17, that abuts against a flange 217, FIG. 15, of the connector/manifold 182. During the early part of the rotation cycle, the third rack 212 enables the gear/cam 216 to push the connector/manifold 182 away from the energy creation system 172 because the gear teeth 214 of the rack 212 engage the gear/cam 216, which moves the connector/manifold before the gear teeth 202 engage the gear trains 208, 210 to rotate the carriers.

In operation, the sixteen shot toy launch apparatus 150 may be primed by an operator who pulls the handle 164 to compress the launch springs. In this first mode the high-pressure air is able to communicate from the cylinders to the barrels; but, in a second mode, before rotation, the cylinders and the barrels are separated. When it is time to rotate the barrel carriers the operator pulls the handle 168 rearward to disengage the connector/manifold from the valve systems and to then rotate the carriers through 180°.

Thirty-Two Shot Toy Launch Apparatus

Figure 18:
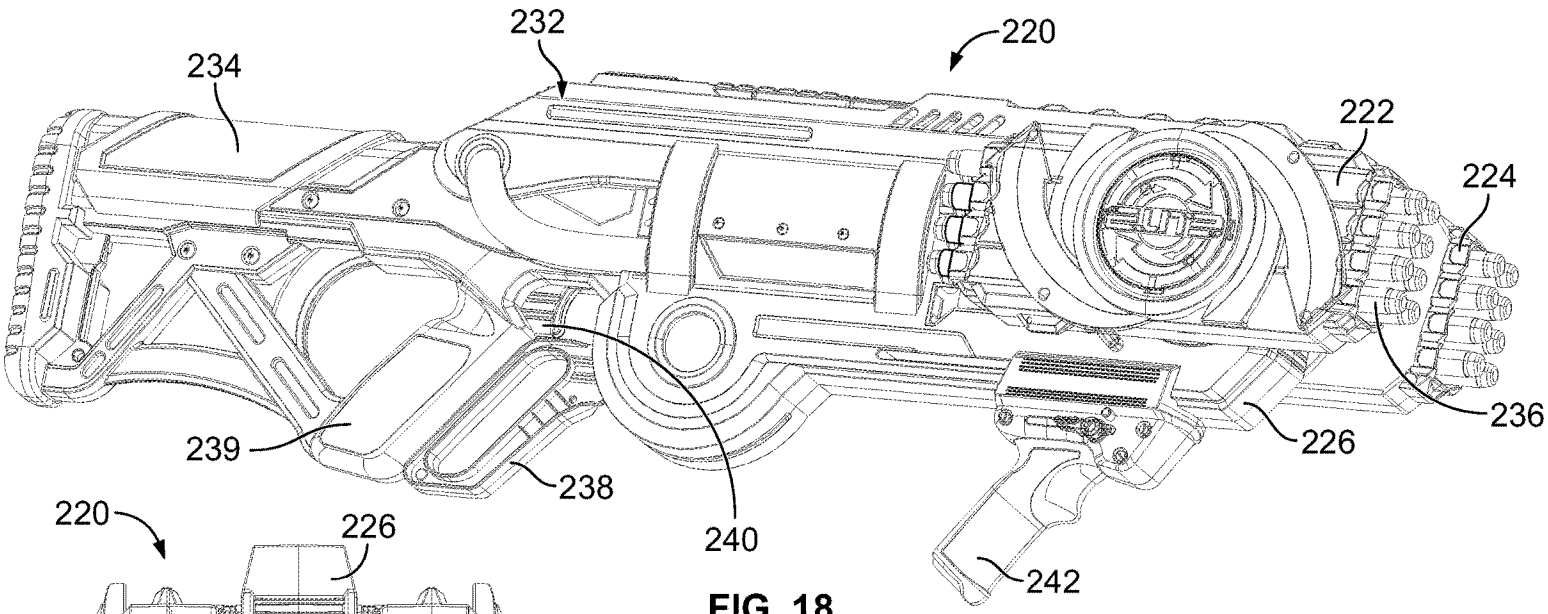
FIG. 18 is an isometric view of a thirty-two shot toy launch apparatus.
Figure 19:
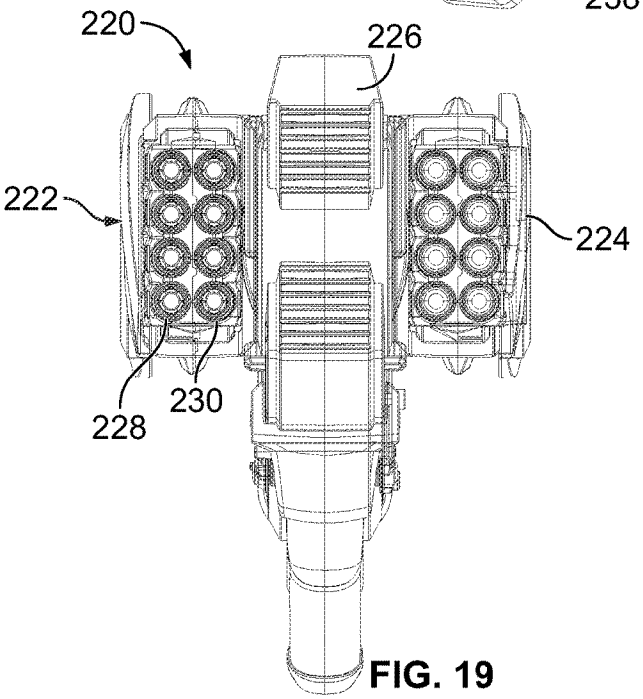
FIG. 19 is an elevation view of the thirty-two shot toy launch apparatus shown in FIG. 18.

The next embodiment is a thirty-two shot toy launch apparatus 220, detailed in FIGS. 18-31. The toy launch apparatus 220 is configured similar to the sixteen launch apparatus 150, but instead of having one carrier to either side of a support arm, the thirty-two shot toy launch apparatus 220 has a package of barrels 222, 224, FIGS. 18 and 19 to each side of a support arm 226. Each package, such as the package 222, includes an outer carrier 228 and an inner carrier 230. The toy launch apparatus 220 includes a simulated rifle-like outer housing 232 with a rearward stock 234 and the forward extending support arm 226. The left barrel passage 222 has a total of sixteen barrels, such as the barrel 236, with eight barrels facing forward. The right barrel package 224 also has a total of sixteen barrels with eight barrels facing forward. The packages of barrels 222, 224 are rotatable simultaneously. A priming handle 238 is mounted to a lower portion of the outer housing 232 adjacent a grip 239. A trigger 240 and a grip-style rotational handle 242 for causing the packages with the carriers to rotate are also mounted to the outer housing 232.

Figure 24:
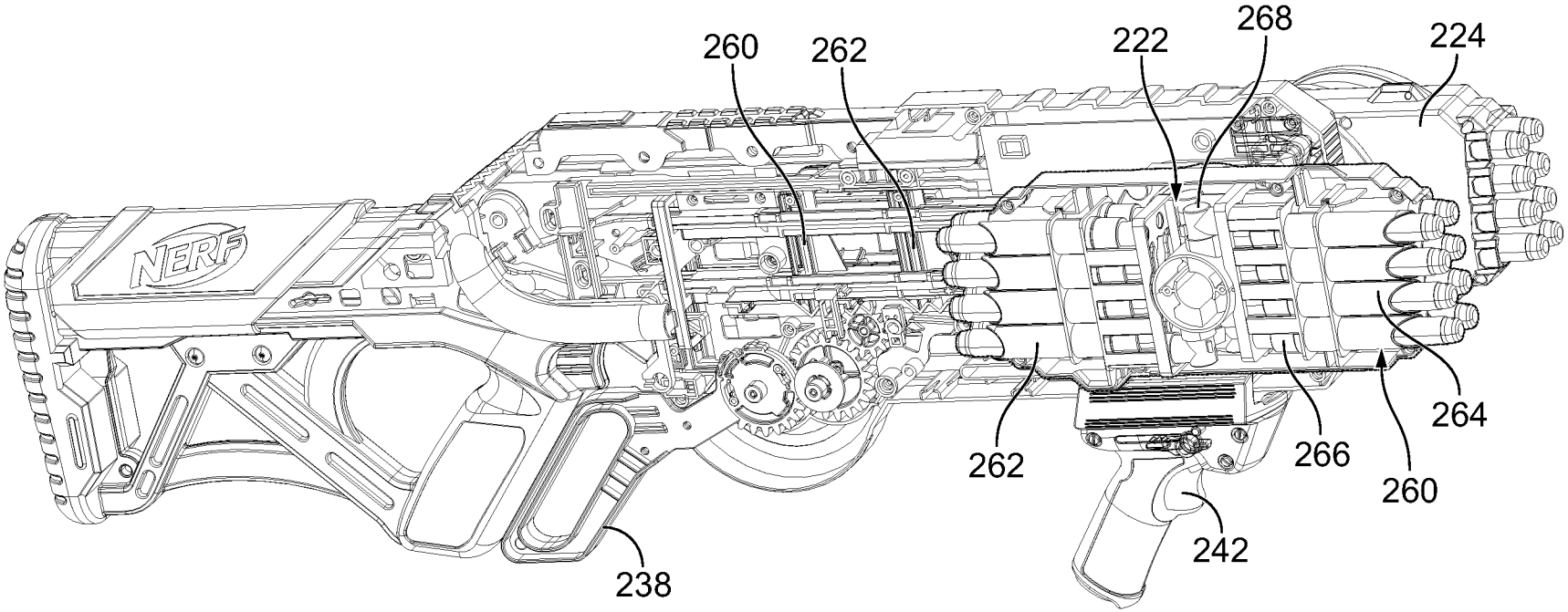
FIG. 24 is an isometric view of a carrier mounted to the toy launch apparatus illustrated in FIG. 18.

As mentioned each of the barrel packages 222 and 224 includes outer and inner carriers, such as the outer carrier 228 and the inner carrier 230, of the package 222, and each of the four carriers of the apparatus 220 is configured like the carrier 34, FIG. 6, with a forward facing module 260, FIG. 24, a rearward facing module 262, a bank of barrels, such as the bank 264, a valve system, such as the valve system 266, as described in detail in U.S. Pat. No. 8,567,378, and incorporated herein by reference, and a center block 268 having switching valves described below. Like the above-mentioned embodiments, the thirty-two shot apparatus include safety spikes and valves.

Figure 20:
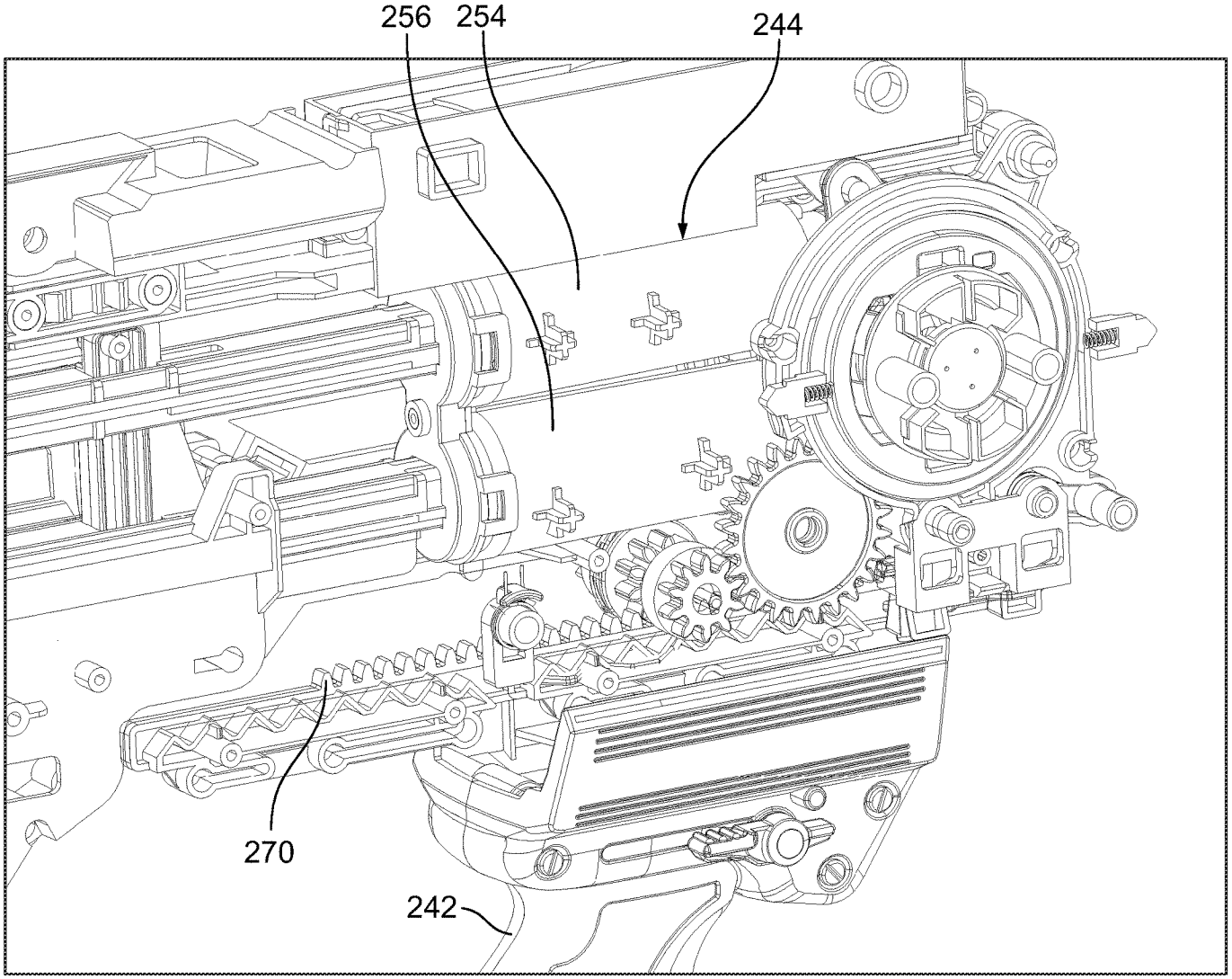
FIG. 20 is an enlarged isometric view of two cylinders of the energy creation system in the toy launch apparatus shown in FIG. 18.
Figure 21:
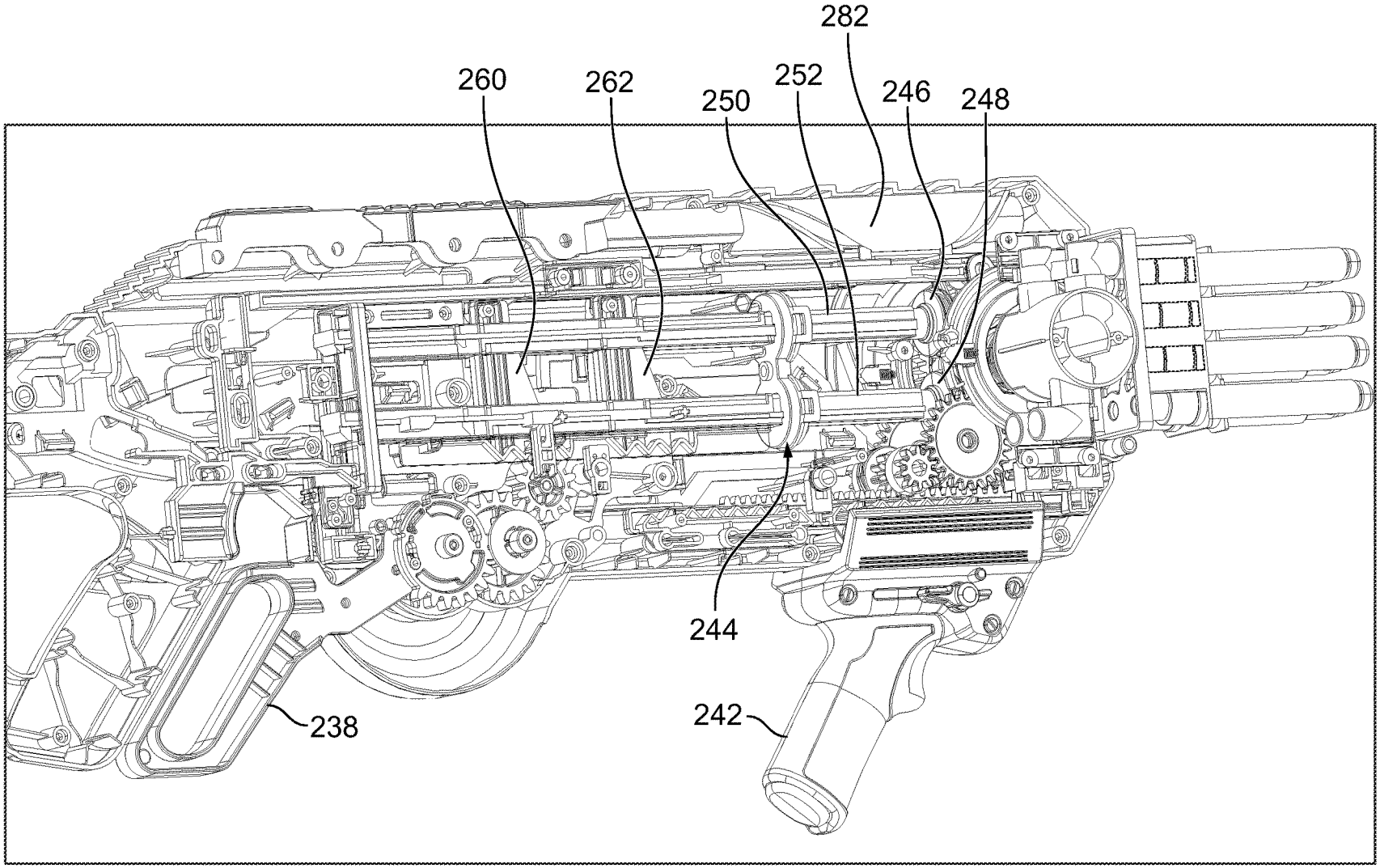
FIG. 21 is an isometric view of two pistons and two launch springs, a priming handle, a gear train connected to the priming handle, a helical cam, a rotational handle and a gear train connected to the rotational handle, all in the toy launch apparatus illustrated in FIG. 18.
Figure 22:
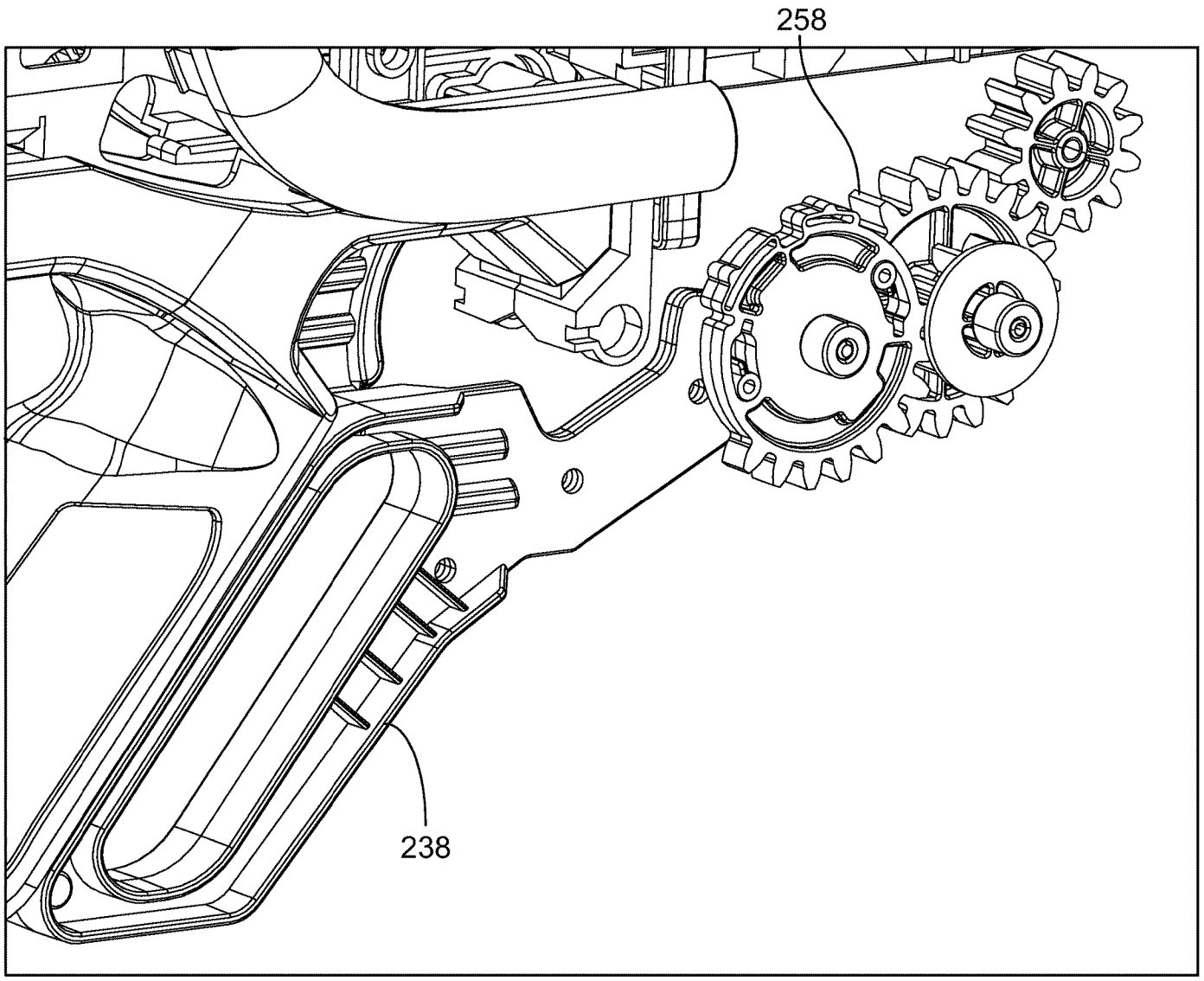
FIG. 22 is an enlarged isometric view of the priming handle and the connected gear train in the toy launch apparatus illustrated in FIG. 18.
Figure 23:
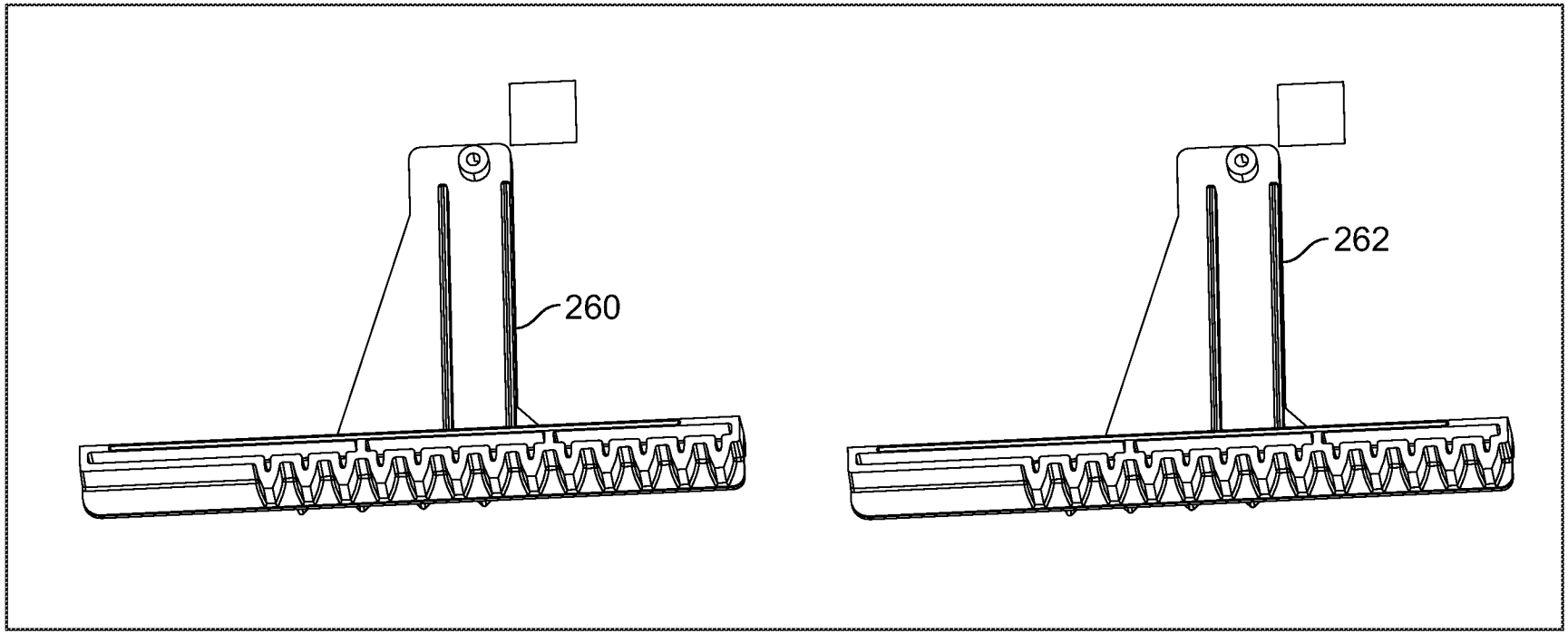
FIG. 23 is an enlarged elevation views of two energy creation racks in the toy launch apparatus illustrated in FIG. 18.

The thirty-two shot apparatus 220 has a very similar energy creation system 244, FIGS. 20 and 21, as the sixteen shot apparatus 150. The thirty-two shot apparatus 220 includes the energy creation system that embodies two pistons 246, 248, and two launch springs 250, 252 mounted in two cylinders 254, 256 and are disposed generally parallel to the longitudinal axis of the toy apparatus 220. The priming handle 238, FIG. 22, is connected to the energy creation system 244 by a gear train 258 and two priming racks 260, 262, FIGS. 21 and 23, to compress the launch springs 250, 252. The pistons, launch springs and cylinders of the energy creation system 244 are described in detail in U.S. Pat. No. 10,823,527, and is incorporated herein by reference.

Figure 25:
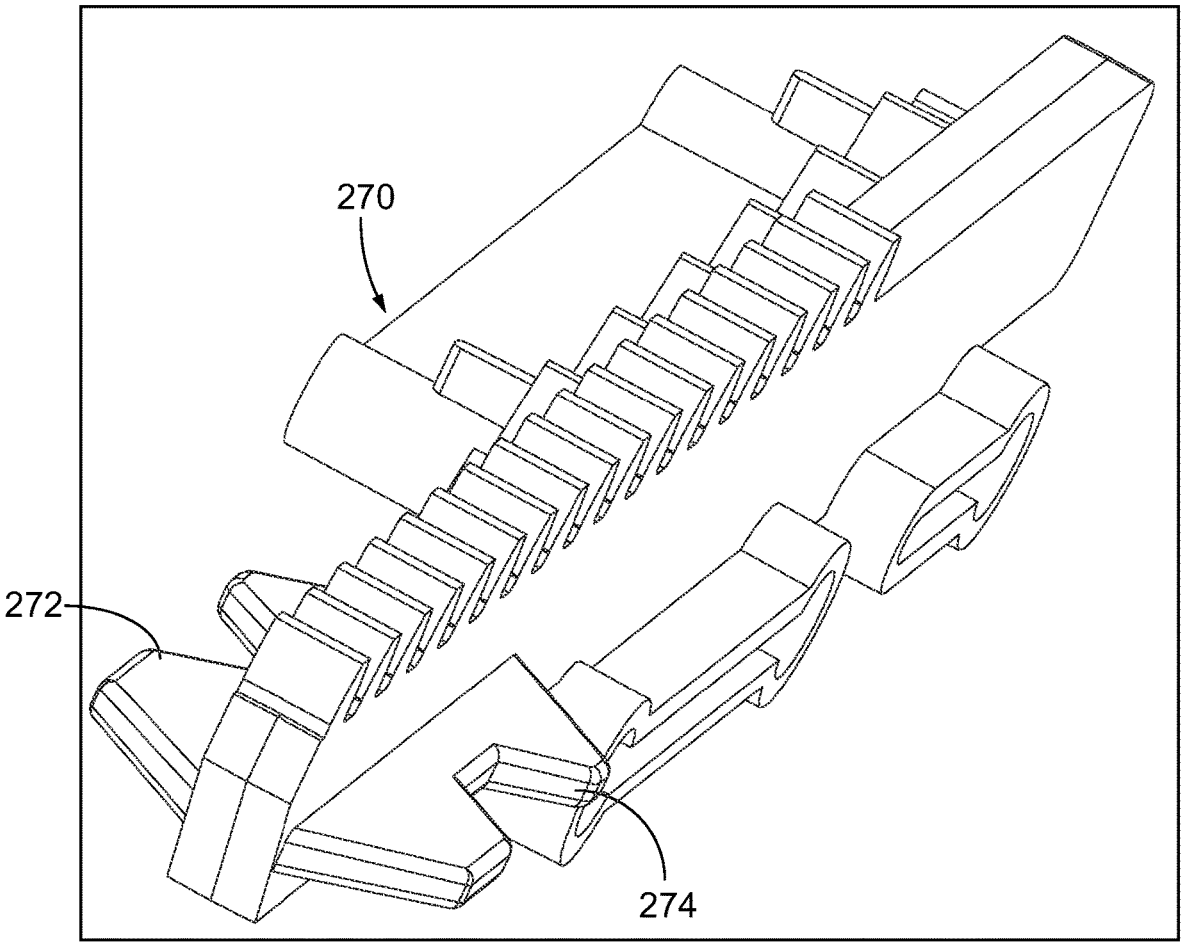
FIG. 25 is an enlarged isometric view of a rotational rack with side cams in the toy launch apparatus illustrated in FIG. 18.
Figure 26:
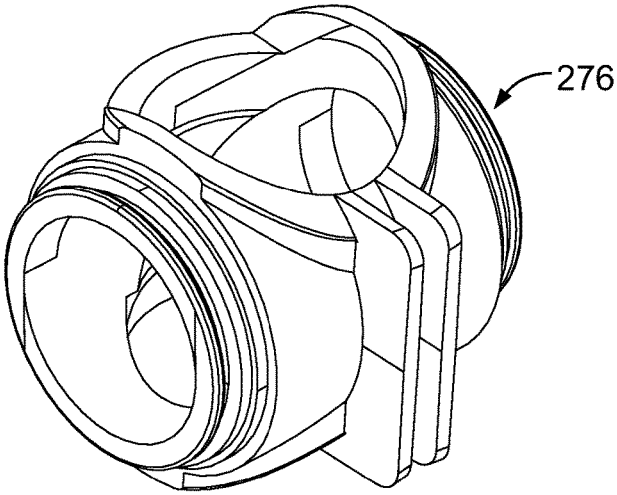
FIG. 26 is an enlarged isometric view of a main air connector in the toy launch apparatus illustrated in FIG. 18.
Figure 27:
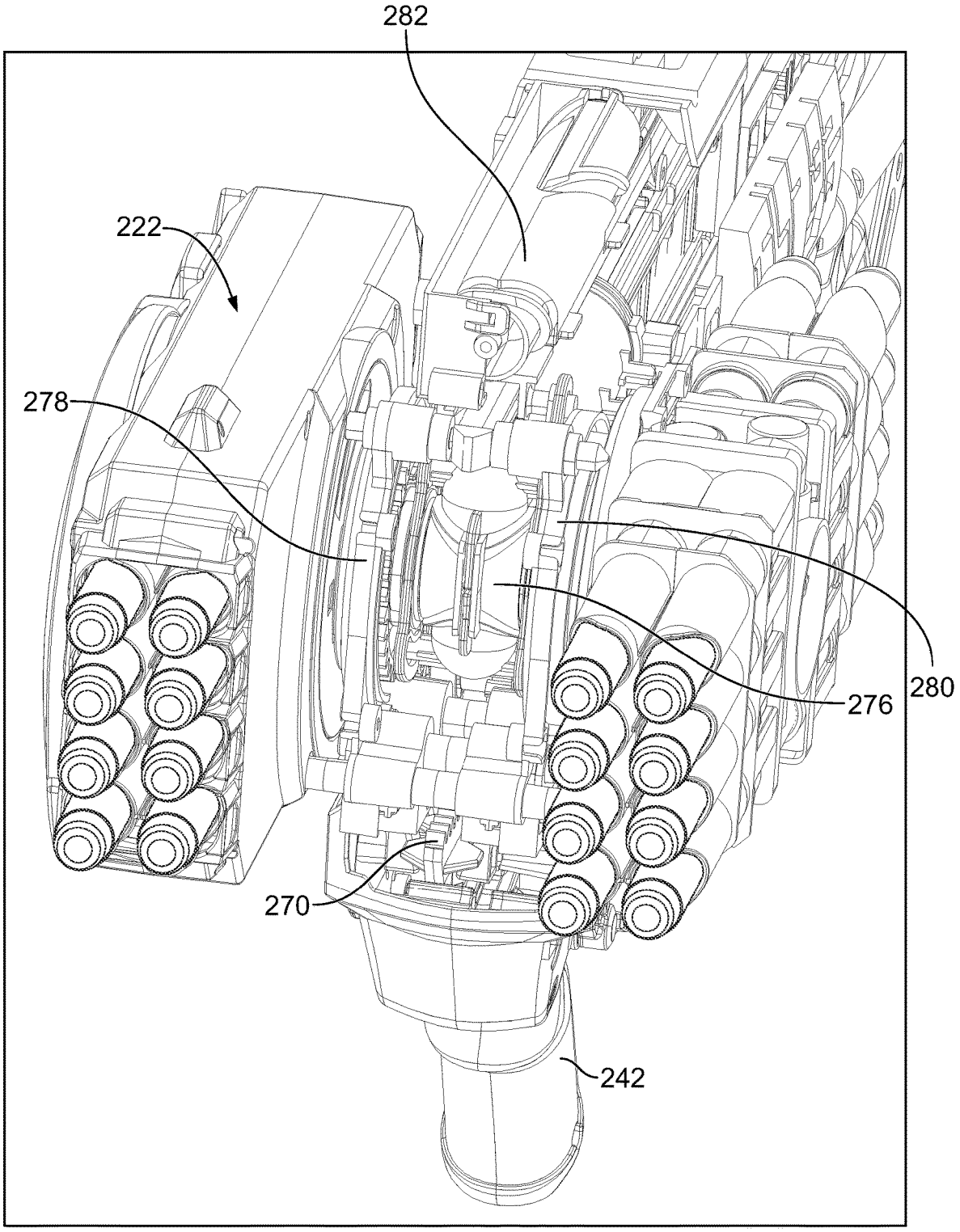
FIG. 27 is an enlarged front isometric view of the main air connector and switching valves in the toy launch apparatus illustrated in FIG. 18.
Figure 28:
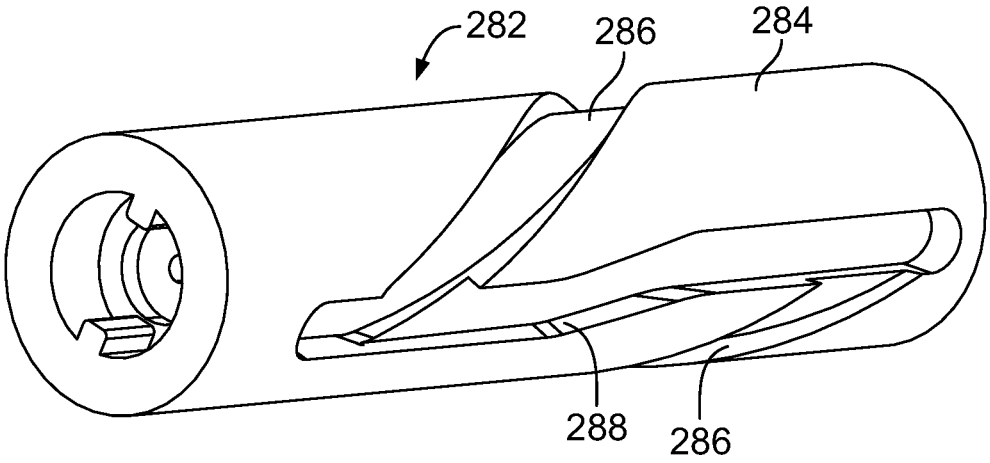
FIG. 28 is an enlarged isometric view of the helical cam in the toy launch apparatus illustrated in FIG. 18.

The rotational system of the toy apparatus 220 includes the rotational handle 242 and a rack 270, FIG. 25, having side cams 272, 274 for disengaging a main air connector 276, FIGS. 26 and 27, from switching valves 278, 280, FIG. 27, mounted to each of the barrel packages 222, 224. Each switching valve, such as the switching valve 280, is connected to a helical cam 282, FIGS. 27 and 28, includes a cylindrical body 284 with a helical groove 286 and a longitudinal return groove 288.

Figure 29:
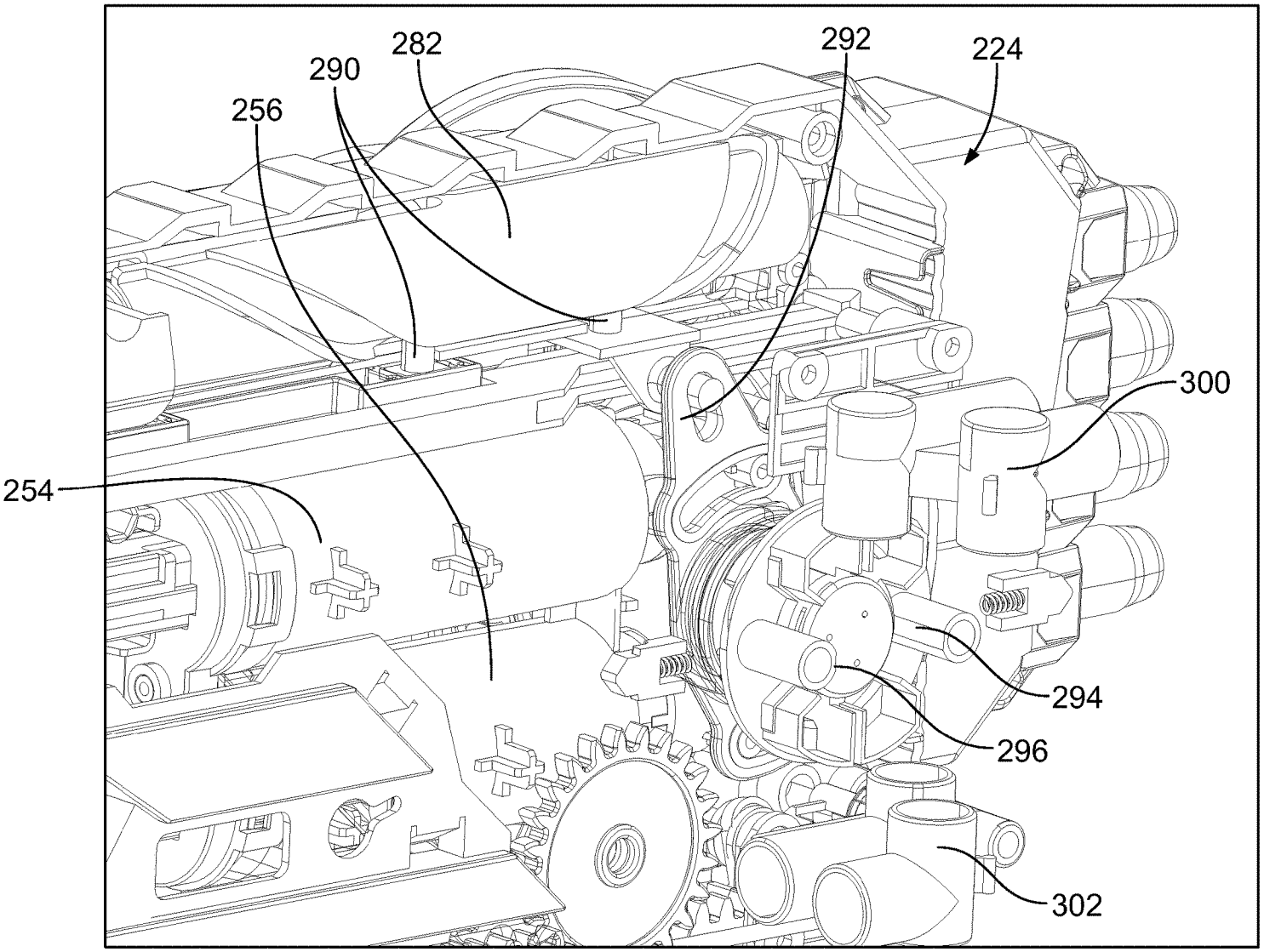
FIG. 29 is an enlarged isometric view of a switching valve, the energy creation cylinders and the helical cam in the toy launch apparatus illustrated in FIG. 18.
Figure 30:
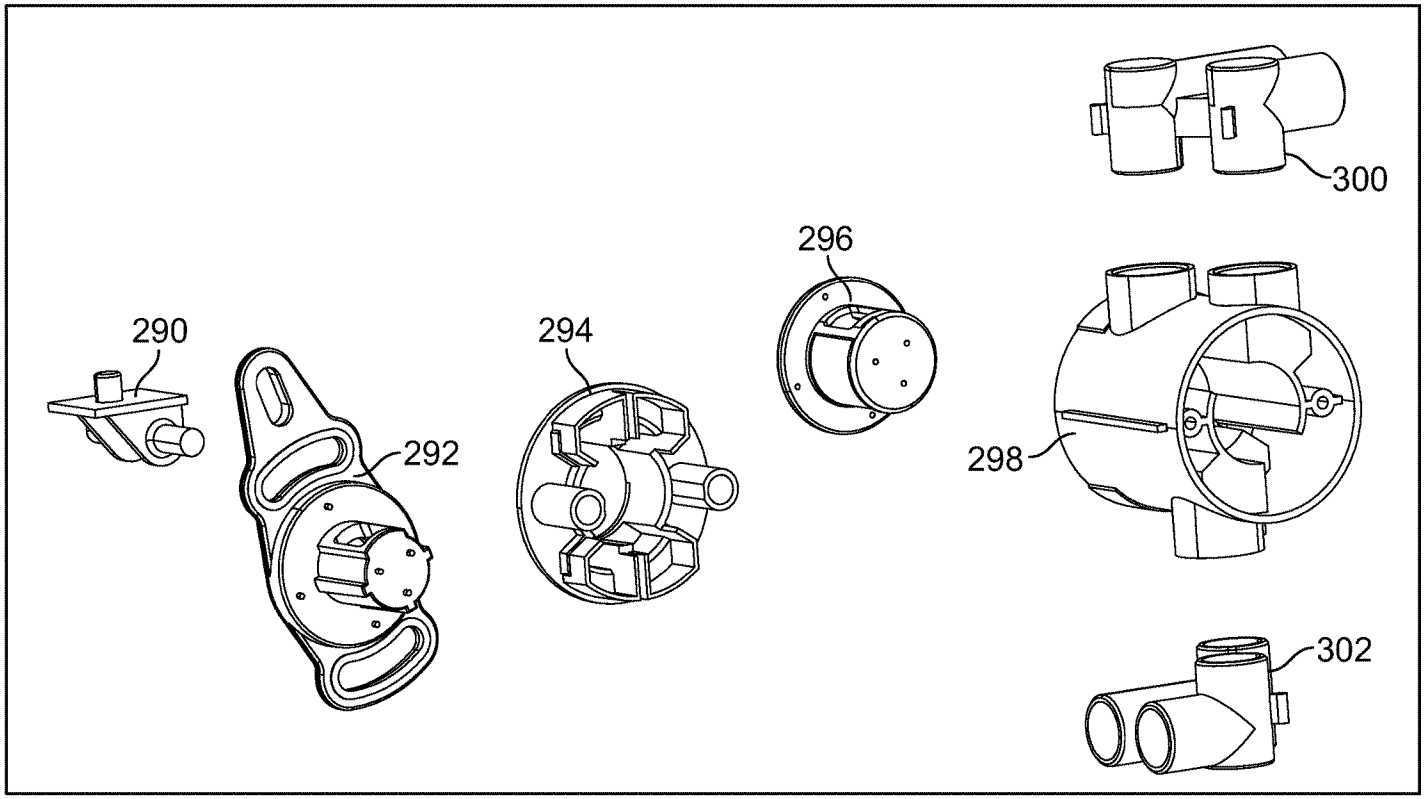
FIG. 30 is an exploded isometric view of the switching valve illustrated in FIG. 29.
Figure 31:
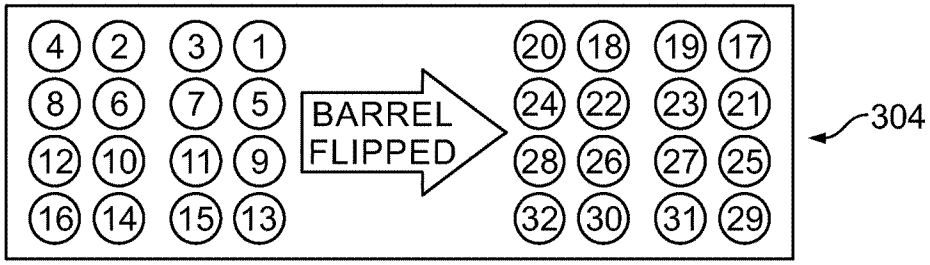
FIG. 31 is a diagram of a launching sequence for the toy launch apparatus illustrated in FIG. 18.
Figure 32:
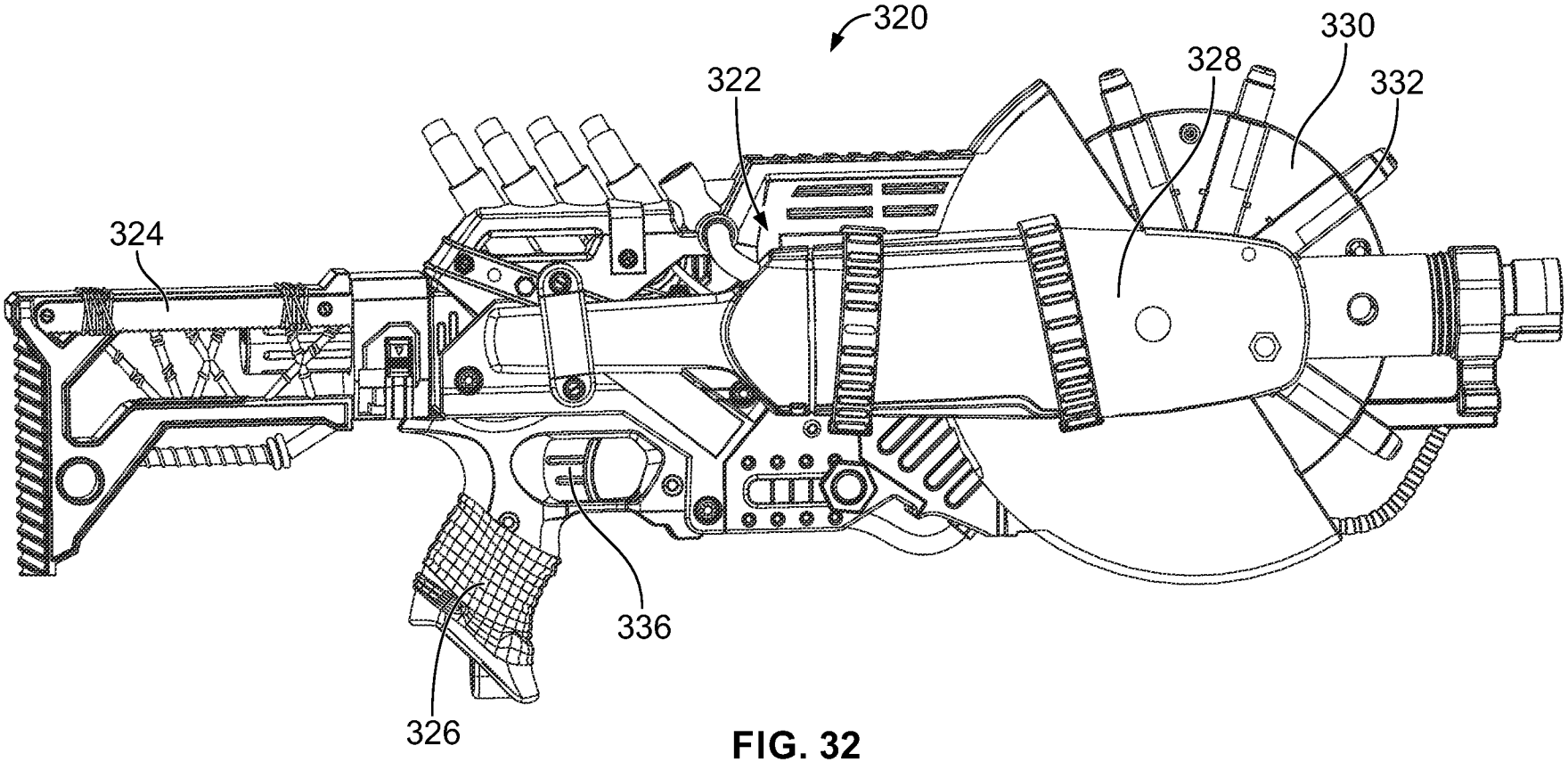
FIG. 32 is a right side elevation view of a ten shot toy launch apparatus.

A switching valve is mounted in each barrel package 222, 224 and each switching valve, such as the switching valve 278, FIG. 29, includes two pins, like the pins 290, FIGS. 29 and 30, that ride in the helical groove 286, a switch link 292, a stationary mount 294, an air director 296, a rotating body 298, and two air connectors 300, 302. Having the two switching valves, the toy launch apparatus 220 is able to have a launch pattern 304, FIG. 31, which shows a discharge sequence of the darts in the thirty-two barrels of the apparatus.

In operation, after loading the barrels, the operator may prime the apparatus by pulling the priming handle 238 forward and then rearward, and when appropriate, pulling the trigger 240 rearward. Like the eight and sixteen shot apparatus, the thirty-two shot apparatus operates in a first mode where the energy creation system communicates high-pressure air to the barrels, but is a second mode the barrels are separated from the energy creation system. Once all sixteen darts that are facing forward are discharged (or if desired, less then sixteen darts), the operator may rotate the barrel packages and repeat the process.

Ten Shot Toy Launch Apparatus

Figure 33:
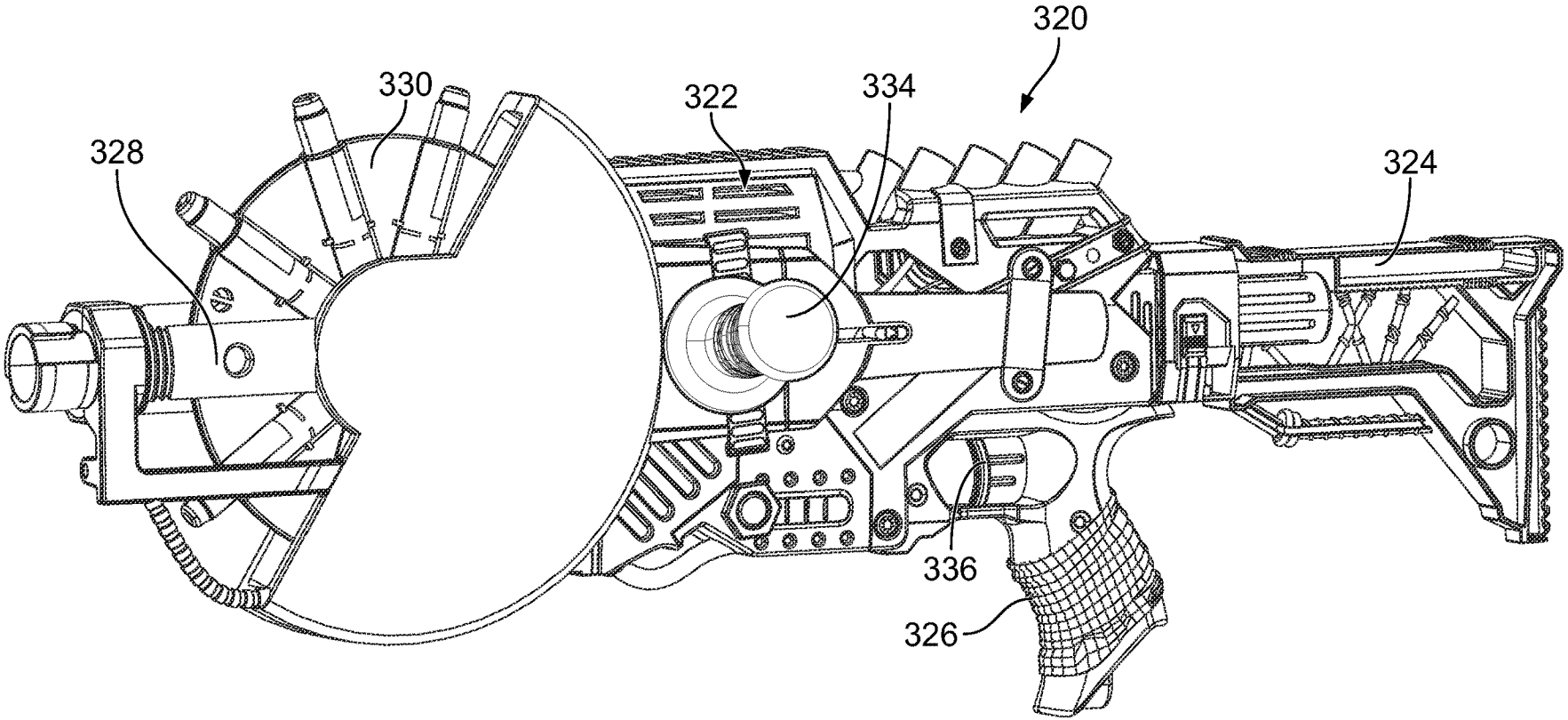
FIG. 33 is a left side isometric view of the ten shot toy launch apparatus shown in FIG. 32.

Yet another embodiment of a toy launch apparatus having a rotatable barrel carrier is illustrated in FIGS. 32-35. The apparatus 320 is designed with a simulated rifle-like outer housing 322 having a rearward stock 324 and grip 326, and a forward support arm 328. Mounted to the support arm 328 is a disc-like barrel carrier 330 having ten recessed barrels, such as the barrel 332. A dual purpose handle 334, FIG. 33, is mounted to the left side of the outer housing 322, and a trigger 336 is located adjacent to the grip 326.

Figure 34:
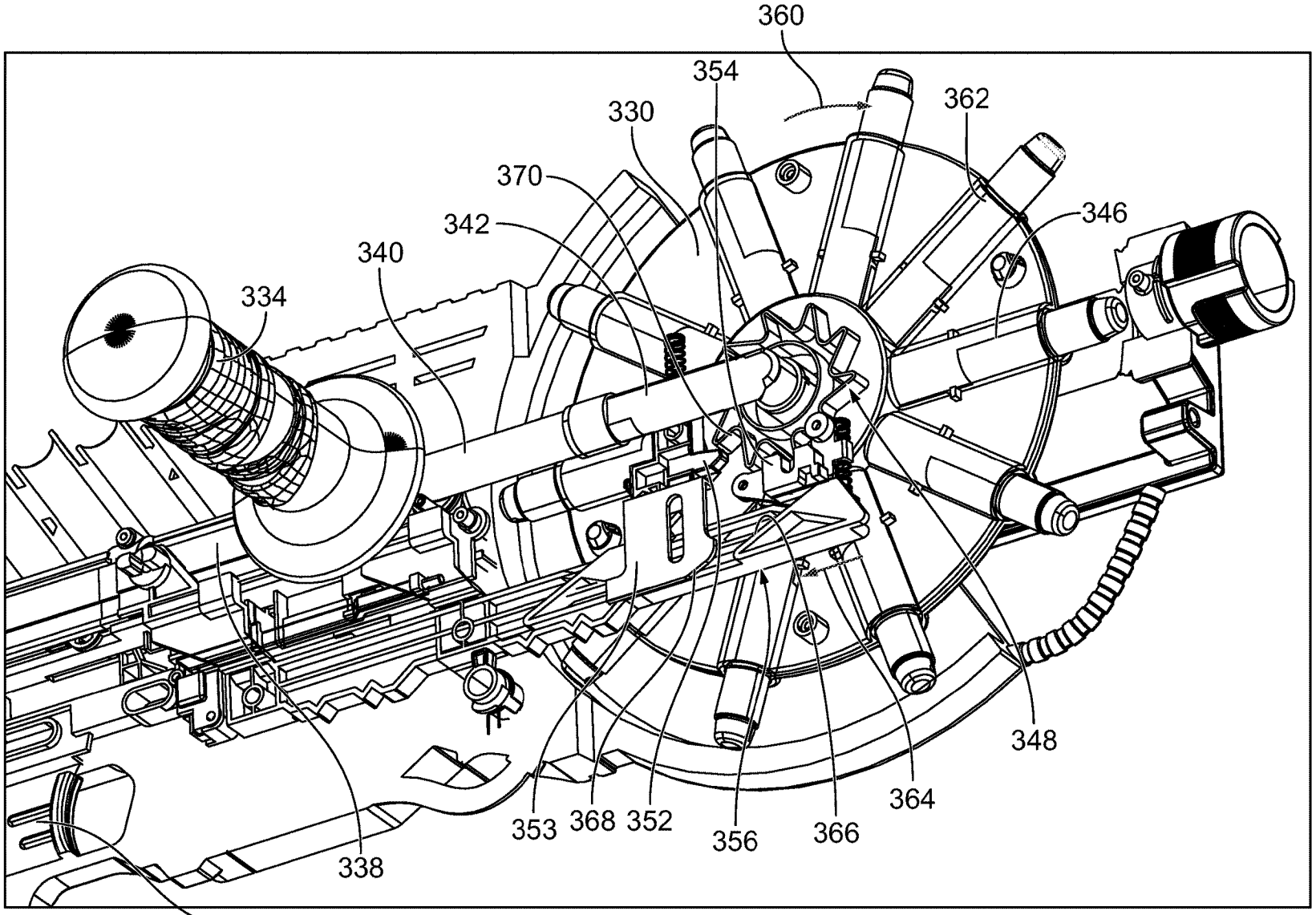
FIG. 34 is an enlarged isometric view of a barrel carrier, a combination priming and rotational handle and an air conduit in the toy launch apparatus shown in FIGS. 32 and 33.
Figure 35:
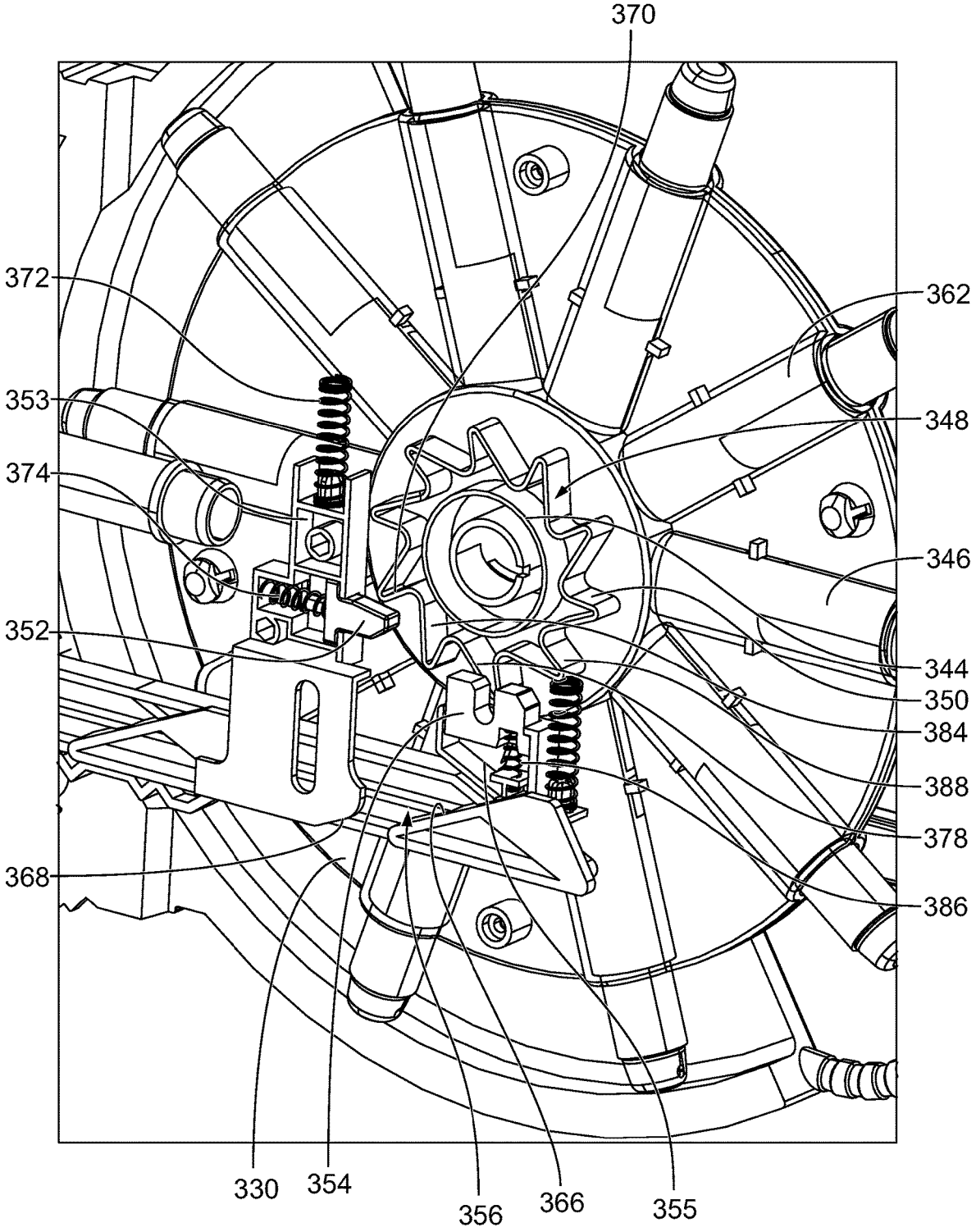
FIG. 35 is an enlarged isometric view of the barrel carrier, a ratchet, a pusher component and a lock component for the barrel carrier in the toy launch apparatus shown in FIGS. 32 and 33.

The toy launch apparatus 320 includes an energy creation system in the form of a cylinder 338, FIG. 34, having a piston and launch spring (not shown) as already described above and referencing U.S. Pat. No. 10,823,527, which is incorporated herein by reference. The trigger 336 is connected to the piston such that a pull on the trigger releases the launch spring and the piston to create a slug of high-pressure air. The cylinder is connected to first and second conduits 340, 342 and an inlet connector 344, FIG. 35, in the hub of the carrier 330. The inlet connector 344 is connected to safety components to prevent inappropriate objects from being discharged. The safety components may include the spike and valve mentioned above covered by a cap having a curved end surface which mates with a curved end surface of each barrel, such as a barrel 346. In one mode high-pressure air may flow from the cylinder 338 to the one of the barrels but in a second mode the cylinder and the barrels are separated. The mating curved surfaces allow the first and second conduits 340, 342 and the inlet connector 344 to be separated from the barrels when the carrier begins to rotate. As rotation begins the valve is closed and the barrel end slides away over the cap. When the inlet connector 344 is aligned with the barrel 346, a slug of high-pressure air emitted from the cylinder 338 travels along the conduits and the inlet connector to the barrel 346, which is shown pointed forward and aligned with a longitudinal axis of the toy launch apparatus 320.

The barrel carrier 330 includes a ratchet 348 having ten teeth, such as the tooth 350, in a circular pattern. Mounted to interact with the ratchet 348 are a pusher component 352 in a pusher bracket 353 and a lock component 354 in a lock bracket 355. A sliding cam rod 356 operates the pusher and lock components 352, 354.

In operation, when the operator moves the dual purpose handle 334 two events take place. One event is that the piston is retracted to compress the launch spring thereby priming the launch apparatus 320. The other event is that the barrel carrier 330 is rotated thirty-six degrees in a clockwise direction, as symbolized by the arrow 360, to move the barrel 362 downward to replace the barrel 346. This is accomplished by the cam rod 356 moving rearward with the handle 334 as symbolized by the arrow 364. The cam rod includes a cam surface 366, which abuts a slanted surface 368 of the pusher bracket 353 causing the pusher component 352 to move upward against a tooth 370 of the ratchet 348 and against a pusher bracket biasing spring 372. The tooth 370 of the ratchet retracts the pusher component 352 against a biasing spring 374. At the same time, the cam rod 356 releases support of a lock bracket 355 allowing a tooth 378 to push the lock component 354 downward as the carrier rotates. When the handle 334 is moved forward to finish its rearward and forward cycle, the pusher bracket 353 and pusher component 352 move downward under the influence of the biasing spring 372 while the pusher component 352 moves outward under the influence of the biasing spring 372 under the next tooth 384 of the ratchet. Simultaneously, the lock bracket 355 moves the lock component 354 upward under the influence of the biasing spring 386 to lock the tooth 388 of the ratchet 348. When the trigger 336 is pulled the dart in the barrel 362 is launched.

It is to be noted that in the alternative, each of the toy launch apparatus embodiments 20, 150, 220, 320 may have more or less barrels than shown and may be configured accordingly. The links, gear trains and rack may also be aligned differently and still function in an acceptable manner. Also in the alternative, the outer housings may have other design themes.

All of the embodiments described here have barrel carriers that are mounted so as to have an axis of rotation that is perpendicular to the longitudinal axis of the toy launch apparatus which offers a novel experience for the operators.

It is further noted that words such as "forward," "rearward," "beneath," "upward," downward," "horizontal," "vertical," "upper," "lower," "back," "front," "rear," "top" and "bottom," as well as other similar positional terms, refer to components or elements of the toy launchers as they are viewed in the attached drawings, or in relationship to the positions of the apparatus as they will typically be deployed and moved during use by an operator, or to movements of elements based on the configurations illustrated.

It may now be appreciated that the toy apparatus disclosed in detail above have great entertainment value, are fun to use and easy to operate. The toy apparatus are robust and have a relatively simple structure that may be produced at a reasonable cost.

From the foregoing, it can be seen that there has been provided a detailed description and features for improved toy launch apparatus. While particular embodiments of the present invention have been shown and described in detail, it will be obvious to those skilled in the art that changes and modifications may be made without departing from the invention in its broader aspects. Therefore, the aim is to cover all such changes and modifications as fall within the true spirit and scope of the invention. The matters set forth in the foregoing description and accompanying drawings are offered by way of illustrations only and not as limitations. The actual scope of the invention is to be defined by the subsequent claims when viewed in their proper perspective based on the prior art.

What is claimed is:

1. A projectile launch apparatus comprising:

an outer housing, the outer housing having at least one forward support arm and a longitudinal axis;

an energy creation system for providing high-pressure air, the energy creation system being mounted in the outer housing;

a handle for priming the energy creation system, the handle being mounted to the outer housing;

a first barrel carrier mounted to the forward support arm to enable rotation, the first barrel carrier mounting a plurality of projectile barrels; and high-pressure air carrying structure connected to the energy creation system and to the first barrel carrier wherein the high-pressure air carrying structure is connected to the first barrel carrier in a first mode and separated from the first barrel carrier in a second mode before the first barrel carrier rotates about an axis perpendicular to the longitudinal axis of the outer housing.

2. The launch apparatus as recited in claim 1, wherein the first barrel carrier has a rotation axis perpendicular to longitudinal axis of outer housing.

3. The launch apparatus as recited in claim 2, comprising a center block having a rack gear and a gear train for rotating the first barrel carrier at the center block.

4. The launch apparatus as recited in claim 2, comprising a center block having gear teeth and a pump-style rotational handle for causing the first barrel carrier to rotate at the center block when the pump-style rotational handle is moved rearward.

5. The launch apparatus as recited in claim 4, wherein the gear teeth and the pump-style rotational handle comprises a ratchet, a pusher, stop and lock components for causing the first barrel carrier to flip by rotating the first barrel carrier through 180° at the center block.

6. The launch apparatus as recited in claim 1, wherein the first barrel carrier comprises a first bank of multiple barrels facing in one direction and a second bank of multiple barrels facing in an opposite direction.

7. The launch apparatus as recited in claim 6, comprising a center block having a gear train for rotating the first barrel carrier and two oppositely disposed inlet connectors from the high-pressure air carrying structure for the first and the second modes connecting and separating the energy creation system from the first bank and second bank of multiple barrels.

8. The launch apparatus as recited in claim 7, comprising a cam structure at the first barrel carrier for moving the two oppositely disposed inlet connectors from the first bank and the second bank of multiple barrels from the high-pressure air carrying structure of the center block.

9. The launch apparatus as recited in claim 8, wherein the cam structure comprises a helical cam and switching valve at the first barrel carrier for sequencing the two oppositely disposed inlet connectors from the first bank and the second bank of multiple barrels for sequencing discharge from the high-pressure air carrying structure of the center block.

10. The launch apparatus as recited in claim 1, further comprising a second barrel carrier having a rotation axis perpendicular to longitudinal axis of outer housing.

11. The launch apparatus as recited in claim 10, wherein the second barrel carrier is mounted to enable rotation at the forward support arm opposite the first barrel carrier mounted to the forward support arm, the second barrel mounting a plurality of projectile barrels thereto.

12. The launch apparatus as recited in claim 3, comprising a second barrel carrier having a rotation axis perpendicular to longitudinal axis of outer housing, the second barrel carrier mounted to enable rotation at the forward support arm opposite the first barrel carrier mounted to the forward support arm, the second barrel mounting a plurality of projectile barrels thereto, further comprising a second rack gear and a second gear train for rotating the second barrel carrier at the center block.

13. The launch apparatus as recited in claim 1, wherein the outer housing further comprises a rearward mounted foldable stock on the outer housing moveable between an extended position and a folded position.

14. A projectile launch apparatus comprising:

an outer housing, the outer housing having at least one forward support arm and a longitudinal axis;

an energy creation system for providing high-pressure air, the energy creation system being mounted in the outer housing;

a handle for priming the energy creation system, the handle being mounted to the outer housing; and a first barrel carrier mounted to the forward support arm to enable rotation, the first barrel carrier mounting a plurality of projectile barrels, wherein the first barrel carrier comprises a first bank of multiple barrels facing in one direction and a second bank of multiple barrels facing in an opposite direction, each bank of multiple barrels having a rotation axis perpendicular to longitudinal axis of outer housing the first barrel carrier.

15. The launch apparatus as recited in claim 14, comprising high-pressure air carrying structure connected to the energy creation system and to the first barrel carrier wherein the high-pressure air carrying structure is connected to the first barrel carrier in a first mode and separated from the first barrel carrier in a second mode before the first barrel carrier rotates about an axis perpendicular to the longitudinal axis of the outer housing.

16. The launch apparatus as recited in claim 15, comprising a center block having a gear train for rotating the first barrel carrier and two oppositely disposed inlet connectors from the high-pressure air carrying structure for the first and the second modes connecting and separating the energy creation system from the first bank and second bank of multiple barrels.

17. The launch apparatus as recited in claim 16, comprising a cam structure at the first barrel carrier for moving the two oppositely disposed inlet connectors from the first bank and the second bank of multiple barrels from the high-pressure air carrying structure of the center block.

18. The launch apparatus as recited in claim 14, further comprising a second barrel carrier having a rotation axis perpendicular to longitudinal axis of outer housing, wherein the second barrel carrier rotates at the forward support arm opposite the first barrel carrier mounted to the forward support arm, the second barrel mounting a plurality of projectile barrels thereto.

19. A projectile launch method comprising the steps of:

providing an outer housing with at least one forward support arm and a longitudinal axis;

mounting an energy creation system in the outer housing for providing high-pressure air;

priming the energy creation system with a handle at the outer housing;

mounting a first barrel carrier to the forward support arm to enable rotation, the first barrel carrier mounting a plurality of projectile barrels; and connecting high-pressure air carrying structure to the energy creation system and to the first barrel carrier sequencing the high-pressure air carrying structure connected to the first barrel carrier in a first mode and separated from the first barrel carrier in a second mode before the first barrel carrier rotates about an axis perpendicular to the longitudinal axis of the outer housing.

20. The launch method as recited in claim 19, providing a second barrel carrier having a rotation axis perpendicular to longitudinal axis of outer housing and mounting the second barrel carrier mounted to enable rotation at the forward support arm opposite the first barrel carrier mounted to the forward support arm, the second barrel mounting a plurality of projectile barrels thereto.

* * * * *